US008764917B2

(12) United States Patent
Suzuki et al.

(10) Patent No.: US 8,764,917 B2
(45) Date of Patent: Jul. 1, 2014

(54) FERROMAGNETIC COMPOUND MAGNET

(75) Inventors: Hiroyuki Suzuki, Hitachi (JP); Matahiro Komuro, Hitachi (JP); Yuichi Satsu, Hitachi (JP); Takao Imagawa, Mito (JP)

(73) Assignee: Hitachi, Ltd., Tokyo (JP)

( * ) Notice: Subject to any disclaimer, the term of this patent is extended or adjusted under 35 U.S.C. 154(b) by 324 days.

(21) Appl. No.: 12/956,253

(22) Filed: Nov. 30, 2010

(65) Prior Publication Data

US 2011/0133112 A1 Jun. 9, 2011

(30) Foreign Application Priority Data

Nov. 30, 2009 (JP) ..... 2009-270968

(51) Int. Cl.
*H01F 1/055* (2006.01)

(52) U.S. Cl.
CPC ..... *H01F 1/055* (2013.01)
USPC ..... 148/301; 252/62.55

(58) Field of Classification Search
None
See application file for complete search history.

(56) References Cited

U.S. PATENT DOCUMENTS

| | | | | |
|---|---|---|---|---|
| 5,733,384 | A * | 3/1998 | Cao et al. | 148/104 |
| 2011/0240909 | A1* | 10/2011 | Kanda et al. | 252/62.55 |
| 2012/0145944 | A1* | 6/2012 | Komuro et al. | 252/62.51 R |

FOREIGN PATENT DOCUMENTS

| | | | |
|---|---|---|---|
| EP | 0 453 270 A2 | * | 10/1991 |
| EP | 0 493 019 A2 | * | 7/1992 |
| JP | 2001-093713 | * | 4/2001 |
| JP | 2008-078610 | | 4/2008 |

OTHER PUBLICATIONS

Zhang, Z.D. et al., "Metastable phases in rare-earth permanent-magnet materials", Journal of Physics D: Appl. Phys. 33 (2000), pp. R217-R246.*

P. Uebele et al., Full-potential linear-muffin-tin-orbital calculations of the magnetic properties of rare-earth-transition-metal intermetallics. III. $Gd_2Fe_{17}Z_3$ (Z=C,N,O,F), Physical Review B, Feb. 1, 1996, vol. 53, No. 6.

J. D. Ardisson et al., Magnetic improvement of $R_2Fe_{17}$ compounds due to the addition of fluorine, Journal of Materials Science Letters 16 (1997).

* cited by examiner

*Primary Examiner* — George Wyszomierski
(74) *Attorney, Agent, or Firm* — Antonelli, Terry, Stout & Kraus, LLP.

(57) ABSTRACT

A ferromagnetic compound magnet in accordance with the present invention includes a ferromagnetic compound based on a binary alloy containing R—Fe system (R is a 4f transition element or Y) or a ternary allay containing R—Fe-T system (R is a 4f transition element or Y, and T is a 3d transition element except for Fe, or Mo, Nb or W), the ferromagnetic compound being characterized by: atomic percentage of the element R to the element Fe or to the elements Fe and T is 15% or lower; an element F is incorporated into an interstitial position in a crystal lattice of the alloy. The ferromagnetic compound is expressed in a chemical formula of: $R_2Fe_{17}F_x$; $R_2(Fe,T)_{17}F_x$; $R_3Fe_{29}F_y$; $R_3(Fe,T)_{29}F_y$; $RFe_{12}F_z$; or $R(Fe,T)_{12}F_z$ ($0<x\leq3$, $0<y\leq4$, $0<z\leq1$).

2 Claims, 10 Drawing Sheets

FERROMAGNETIC COMPOUND MAGNET

CLAIM OF PRIORITY

The present application claims priority from Japanese patent application ser. no. 2009-270968 filed on Nov. 30, 2009, the content of which is hereby incorporated by reference into this application.

BACKGROUND OF THE INVENTION

1. Field of the Invention

The present invention relates to permanent magnets made of a 4f transition element-3d transition element alloy and, in particular, to a structure and a composition of a compound, which improves the magnetic properties of the permanent magnet.

2. Description of Related Art

An improvement in the performance of material for a permanent magnet can be indicated by three characteristics: Curie temperature, magnetization, and magnetic anisotropy. One known method for drastically improving these three characteristics is to insert a nonmagnetic atom to a parent-phase crystal of a magnetic compound. For example, as stated in JP-A 2008-78610, $Sm_2Fe_{17}$ (Sm: samarium, Fe: iron) is intruded by a non-magnetic element N (nitrogen) to improve the magnetic properties of the parent phase. In addition, as stated in academic paper 1 (Uebele et al.), when the non-magnetic element is F (fluorine), it is calculated that the most improvement in magnetic properties would be seen in $R_2Fe_{17}$ (R is a 4f transition element). Actually, as stated in academic paper 2 (Ardisson et al.), it has been known that the Curie temperature would be increased by the intrusion of the element F.

Academic paper 1: P. Uebele, K. Hummler, and M. Fahnle, "Full-potential linear-muffin-tin orbital calculations of the magnetic properties of rare-earth-transition-metal intermetallics. III. $Gd_2Fe_{17}Z_3$ (Z=C, N, O, F)", Phys. Rev. B 53, 3296 (1996).

Academic paper 2: J. D. Ardisson, A. I. C. Persiano, L. O. Ladeira, and F. A. Batista, "Magnetic improvement of $R_2Fe_{17}$ compounds due to the addition of fluorine", J. Mat. Sci. Lett. 16 (1997) 1658.

$Nd_2Fe_{14}B$ (Nd: neodymium, B: boron), which has the highest performance among existing permanent magnet materials, still requires a great amount of rare-earth element, which is a scarce resource (the atomic percentage of the element Nd to the element Fe is 14.3%). For this reason, it is important to use a composition having a smaller amount of rare-earth element than the above in improving magnetic properties. $Sm_2Fe_{17}N_3$ described in JP-A 2008-78610 is improved in magnetic properties than its parent phase, but still has an insufficient magnetic moment and magnetic anisotropy. $Gd_2Fe_{17}F_3$ reported by Uebele et al. is calculated to have an increased magnetic moment and an increased magnetic anisotropy; however, the stability of its crystal structure is not discussed so that whether it can stably exist as an actual system or not is unclear. The Curie temperature is not mentioned in Uebele et al. either. In the academic paper by Ardisson et al., no element analysis of F was performed with regard to $R_2Fe_{17}F_x$, thus, whether the effect is caused by the element F or not is unclear. In addition, it is challenged by the fact that the maximum increase in the Curie temperature is only about 40° C., which is still small.

SUMMARY OF THE INVENTION

In view of the foregoing, it is an objective of the present invention to provide a ferromagnetic compound including fluorine and a permanent magnet comprising the ferromagnetic compound which can drastically improve the magnetic properties of a main phase, raise the Curie temperature, increase magnetization, and improve magnetic anisotropy.

(I) According to one aspect of the present invention, there is provided a ferromagnetic compound magnet including a ferromagnetic compound based on a binary alloy containing R—Fe system (R is a 4f transition element or Y (yttrium)) or a ternary alloy containing R—Fe-T system (R is a 4f transition element or Y, and T is a 3d transition element except for Fe, or Mo (molybdenum), Nb (niobium) or W (tungsten)), the ferromagnetic compound being characterized by: atomic percentage of the element R to the element Fe or to the elements Fe and T is 15% or lower; an element F is incorporated into an interstitial position in a crystal lattice of the alloy; and the ferromagnetic compound is expressed in a chemical formula of $R_2Fe_{17}F_x$ or $R_2(Fe,T)_{17}F_x$ ($0<x\leq3$).

(II) According to another aspect of the present invention, there is provided a ferromagnetic compound magnet including a ferromagnetic compound based on a binary alloy containing R—Fe system (R is a 4f transition element or Y) or a ternary alloy containing R—Fe-T system (R is a 4f transition element or Y, and T is a 3d transition element except for Fe, or Mo, Nb or W), the ferromagnetic compound being characterized by: atomic percentage of the element R to the element Fe or to the elements Fe and T is 15% or lower; an element F is incorporated into an interstitial position in a crystal lattice of the alloy; and the ferromagnetic compound is expressed in a chemical formula of $R_3Fe_{29}F_y$ or $R_3(Fe,T)_{29}F_y$ ($0<y\leq4$).

(III) According to still another aspect of the present invention, there is provided a ferromagnetic compound magnet including a ferromagnetic compound based on a binary alloy containing R—Fe system (R is a 4f transition element or Y) or a ternary alloy containing R—Fe-T system (R is a 4f transition element or Y, and T is a 3d transition element except for Fe, or Mo, Nb or W), the ferromagnetic compound being characterized by: atomic percentage of the element R to the element Fe or to the elements Fe and T is 15% or lower; an element F is incorporated into an interstitial position in a crystal lattice of the alloy; and the ferromagnetic compound is expressed in a chemical formula of $RFe_{12}F_z$ or $R(Fe,T)_{12}F_z$ ($0<z\leq1$).

In the above aspects (I), (II) and (III) of the invention, the following modifications and changes can be made.

(i) The element R is Sm; and when increase rate (%) of Curie temperature of the ferromagnetic compound is plotted against expansion rate (%) of a-axis lattice constant thereof due to an F incorporation into the crystal lattice, a ratio of "[the increase rate of Curie temperature]/[the expansion rate of a-axis lattice constant]" is 25.2 (±5), and its ordinate intercept is 1.8 (±3).

(ii) The element R is Nd; and when increase rate (%) of Curie temperature of the ferromagnetic compound is plotted against expansion rate (%) of a-axis lattice constant thereof due to an F incorporation into the crystal lattice, a ratio of "[the increase rate of Curie temperature]/[the expansion rate of a-axis lattice constant]" is 7.2 (±2.2), and its ordinate intercept is 39.2 (±1.5).

(iii) The element R is Sm; and when increase rate (%) of Curie temperature of the ferromagnetic compound is plotted against expansion rate (%) of unit-cell volume thereof due to an F incorporation into the crystal lattice, a ratio of "[the increase rate of Curie temperature]/[the expansion rate of unit-cell volume]" is 12.8 (±4), and its ordinate intercept is 1.8 (±5).

(iv) The element R is Nd; and when increase rate (%) of Curie temperature of the ferromagnetic compound is plotted against expansion rate (%) of unit-cell volume thereof due to an F incorporation into the crystal lattice, a ratio of "[the increase rate of Curie temperature]/[the expansion rate of unit-cell volume]" is 4.3 (±1.5), and its ordinate intercept is 38.3 (±1.0).

(v) The element R is Sm or Nd; and when increase rate (%) of saturation magnetization per unit mass of the ferromagnetic compound at 17° C. is plotted against expansion rate (%) of a-axis lattice constant thereof due to an F incorporation into the crystal lattice, a ratio of "[the increase rate of saturation magnetization per unit mass at 17° C.]/[the expansion rate of a-axis lattice constant] is 22.3 (±5).

(vi) The element R is Sm or Nd; and when increase rate (%) of saturation magnetization per unit mass of the ferromagnetic compound at 17° C. is plotted against expansion rate (%) of unit-cell volume thereof due to an F incorporation into the crystal lattice, a ratio of "[the increase rate of saturation magnetization per unit mass at 17° C.]/[the expansion rate of unit-cell volume] is 11.7 (±5).

(vii) The element R is Sm, Er or Tm; and the ferromagnetic compound has uniaxial magnetic anisotropy.

(viii) The element R is Pr, Nd, Tb or Dy; and the ferromagnetic compound has uniaxial magnetic anisotropy.

(ix) The alloy has a phase decomposition temperature higher than the Curie temperature; and a difference between the phase decomposition temperature and the Curie temperature is 20 to 120° C.

(x) The ferromagnetic compound magnet further includes Fe, $FeF_2$, and $FeF_3$ as another phase in addition to the ferromagnetic compound as a main phase.

(xi) An F concentration is higher in crystal grain boundary region of the ferromagnetic compound than in crystal grain center region thereof.

(xii) An F constituent has a concentration gradient from crystal grain boundary region of the ferromagnetic compound toward crystal grain center region thereof.

(xiii) A fluoride layer is formed around crystal grains or magnetic powders of the ferromagnetic compound.

(xiv) A rotary electric machine comprises a rotor including the above-described ferromagnetic compound magnet.

(Advantages of the Invention)

According to the present invention, it is possible to provide a ferromagnetic compound including fluorine and a permanent magnet comprising the ferromagnetic compound that can drastically improve the magnetic properties of a main phase, raise the Curie temperature, increase magnetization, and improve magnetic anisotropy.

DETAILED DESCRIPTION OF THE PREFERRED EMBODIMENTS

Figure 1:
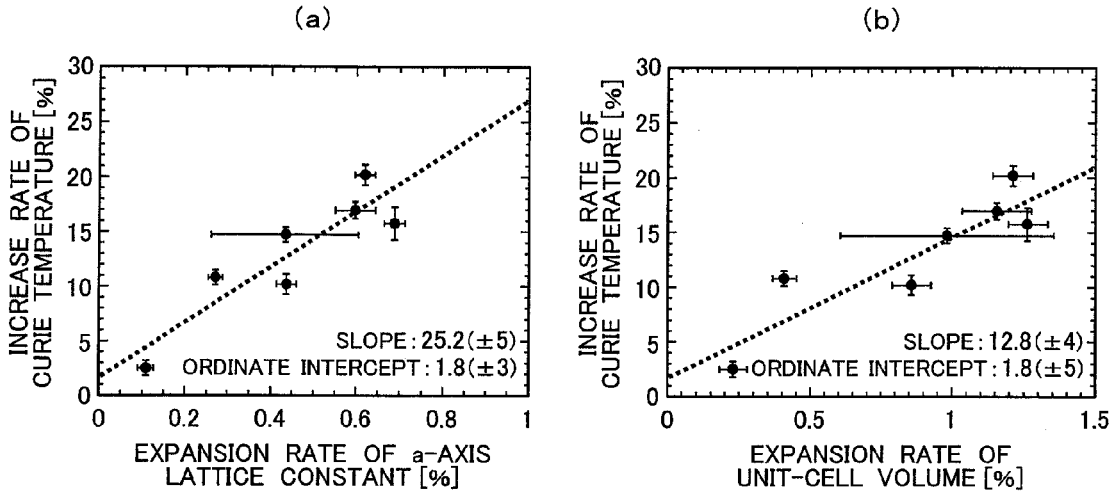
FIG. 1 is graphs showing: (a) a relationship between increase rate of Curie temperature of $Sm_2Fe_{17}F_x$ and expansion rate of a-axis lattice constant thereof; and (b) a relationship between increase rate of Curie temperature of $Sm_2Fe_{17}F_x$ and expansion rate of unit-cell volume thereof.

In a magnetic material based on a transition metal, magnetism appears by band polarization. A 3d transition metal group having a relatively strong itinerancy is often described by the Hubbard model, and a 4f rare-earth metal group having a strong locality is often described by the Anderson model. In the Hubbard model, a mutual action between a gain of kinetic energy reduction due to the spatial expansion of electrons and an increase in Coulomb energy due to the convergence of electrons determines a state of electrons or a magnetic structure of the magnetic material. In the Anderson model, the state of electrons or the magnetic structure is determined based on the Hubbard model with additional consideration of the mutual interaction between conduction electrons and localized electrons. The principle of the present invention relates to the Kanamori theory calculated from the single Hubbard model of a 3d transition metal. The Kanamori condition excludes an overestimation of Coulomb energy from the Stoner condition, and, giving an indicator for the appearance of ferromagnetism, represented in the following equation (Eq. 1).

$$\frac{U}{1 + U \cdot G(0, 0)} D(E_F) > 1 \quad \text{(Eq. 1)}$$

Herein, U is Coulomb energy; G(0,0) is a parameter between two electrons having a wave vector of "0", showing a magnitude of the reciprocal of 3d bandwidth; and $D(E_F)$ is a state density of electrons at the Fermi level.

The Kanamori condition of Eq. 1 indicates that, in order to generate ferromagnetism, a bandwidth needs to be significantly large and at the same time, the state density at the Fermi level needs to be locally large. Since the electron state density increases with increasing a crystal lattice, the electron state density changes according to a change in a unit-cell volume. Thus, when the unit-cell volume is changed either forcibly or voluntary, the state density near the Fermi level is expected to be changed, creating a large change in magnetic properties.

For example, the Bethe-Slater curve (or Néel Slater curve), which shows a relationship between an interatomic-distance dependency and the magnitude of exchange interaction in a 3d transition metal alloy, also shows that the interaction in itinerant electron magnetism vibrates according to interatomic distances. It has been known that, in order to maximize the exchange interaction in the positive region of the Bethe-Slater curve, α-Fe (hereinafter, simply shown as Fe) is too short in the interatomic distance, and Co and Ni are too wide in the same. This means that, Fe has a small exchange interaction because its electron itinerancy is too strong and localized electrons too few, and Co and Ni each have a small exchange interaction because their localities are too strong and their wave function overlaps are small. In other words, the exchange interaction can be increased in Fe by enlarging the interatomic distance to increase the locality; and in Co and Ni by reducing the interatomic distance to increase the itinerancy. In addition to this, an RKKY interaction can be calculated from the Anderson model and has been actually observed, in which interaction, the electric field of localized electrons in an atom causes the surrounding conduction electrons to be spin-polarized, consequently interacting with localized electrons in the next atom. In the RKKY interaction also, the exchange interaction vibrates according to interatomic distances.

In a ferromagnetic compound containing R—Fe system (R is a 4f transition element or Y) or R—Fe-T system (T is a 3d transition element except for Fe, or Mo, Nb or W) according to the present invention, the element F is incorporated into a parent phase of an R—Fe alloy or R—Fe-T alloy to reduce the state density of the element Fe near the Fermi level and to increase the locality of Fe, thereby creating the effects of a magnetization increase and Curie temperature rise. Furthermore, the incorporation of element F improves magnetic anisotropy of the phase by its strong electronegativity. In particular, phases in general, having a crystal structure based on a $CaCu_5$ structure, such as $R_2(Fe,T)_{17}$, $R_3(Fe,T)_{29}$, and $R(Fe,T)_{12}$ are a ferromagnetic material whose magnetic properties in the parent phase will be drastically improved by incorporating the element F. In these structures, generally, the element N (nitrogen) is known to dispose as $R_2(Fe,T)_{17}N_x$ ($0<x\leq3$), $R_3(Fe,T)_{29}N_y$ ($0<y\leq4$), and $R(Fe,T)_{12}N_z$ ($0<z\leq1$), and the element F is expected to be the same. When the incorporation amount of F is too large, overly strong locality causes an Fe bandwidth to be narrow, which does not satisfy the Kanamori condition, thus its ferromagnetism will be reduced. In other words, the significant effects of magnetization increase and Curie temperature rise by the F incorporation can be seen only in a crystal structure having a site with a short interatomic distance between Fe atoms. Generally, the exchange interaction between Fe atoms is switched between positive and negative around a value of 0.245 nm (an Fe interatomic distance for maximizing the exchange interaction value is around 0.26 nm). Therefore, the effect of ferromagnetism increase by the incorporation of F is prominent in a crystal structure whose interatomic distance between Fe atoms is shorter than 0.245 nm.

There are some methods for fluorinating a parent phase of the R—Fe alloy and R—Fe-T alloy. For example, a method is to utilize the thermal decomposition and sublimation of ammonium fluoride ($NH_4F$), bifluoride ammonium ($NH_4F.HF$), ammonium silicofluoride [$(NH_4F)_2SiF_6$], and ammonium fluoroborate ($NH_4BF_4$); and another method is to use a gas flow of nitrogen trifluoride ($NF_3$), boron trifluoride ($BF_3$), hydrogen fluoride (HF), and fluorine ($F_2$). Naturally, these can be mixed or simultaneously used. The fluorination method used in the present invention is characterized by a reduction diffusion reaction in which, F intrudes into a parent phase of the alloy by displacement when oxidation products naturally formed on a surface of the parent-phase powders are reduced.

For example, $Sm_2Fe_{17}$ was heat-treated for fluorination at a temperature lower than 400° C. using the sublimation of $NH_4F$, and a ferromagnetic fluorine compound magnet having the following characteristics was successfully synthesized. The concept of the present invention is based on the characteristics of element Fe described above, and its fundamental is that the incorporation of F increases the unit-cell volume of the alloy crystal, creating a geometric effect to significantly increase the magnetic moment and raise the Curie temperature. Because of this, a magnet made of the ferromagnetic fluorine compound in the present invention has the following five characteristics correlated with the element Fe.

(1) The ferromagnetic fluorine compound is characterized by the fact that the expansion rate of the a-axis lattice constant is correlated with the increase rate of Curie temperature, and in particular, when the element R is Sm, a ratio of "[the increase rate of Curie temperature (%)]/[the expansion rate of a-axis lattice constant (%)]" is 28.5 (±5); or when the element R is Nd, a ratio of "[the increase rate of Curie temperature (%)]/[the expansion rate of a-axis lattice constant (%)]" is 7.2 (±2.2). (See FIGS. 1(*a*) and 2(*a*) to be described later.)

(2) The ferromagnetic fluorine compound is characterized by the fact that unit-cell volume is correlated with the increase rate of Curie temperature, and in particular, when the element R is Sm, a ratio of "[the increase rate of Curie temperature (%)]/[the expansion rate of unit-cell volume (%)]" is 14.6 (±4); or when the element R is Nd, a ratio of "[the increase rate of Curie temperature (%)]/[the expansion rate of unit-cell volume (%)]" is 4.3 (±1.5). (See FIGS. 1(*b*) and 2(*b*) to be described later.)

(3) The ferromagnetic fluorine compound is characterized by the fact that the expansion rate of the a-axis lattice constant is correlated with the increase rate of saturation magnetization per unit mass of the compound at 17° C., and in particular, when the element R is Sm, a ratio of "[the increase rate of saturation magnetization (%)]/[the expansion rate of a-axis lattice constant (%)]" is 22.3 (±5). (See FIG. 3(*a*) to be described later.)

(4) The ferromagnetic fluorine compound is characterized by the fact that the unit-cell volume is correlated with the increase rate of saturation magnetization per unit mass of the compound at 17° C., and in particular, when the element R is Sm, a ratio of "[the increase rate of saturation magnetization (%)]/[the expansion rate of unit-cell volume (%)]" is 11.7 (±5). (See FIG. 3(*b*) to be described later.)

(5) The ferromagnetic fluorine compound is characterized by the fact that the Curie temperature is correlated with phase-decomposition temperature, and in particular, the phase-decomposition temperature is 80 (±20)° C. higher than the Curie temperature. (See FIG. 4 to be described later.)

In addition, there is a characteristic correlated with the element R as below.

(6) The ferromagnetic fluorine compound is characterized by the fact that, when the element R is Sm, Er (erbium), or Tm (thulium), the parent-phase of alloy having in-plane magnetic anisotropy is synthesized to the ferromagnetic fluorine compound whose anisotropy is reformed to uniaxial magnetic anisotropy. (See FIG. 5 to be described later.)

Furthermore, the effects of a magnetization increase and Curie temperature rise can also be produced by the localization of Fe caused by the strong electronegativity of F. The spatial size of an interstitial position varies depending on the kind of element R (4f transition elements and Y) so that the increase rate of magnetization and the increase rate of Curie temperature will be characteristically different depending on the type of the element R. This can be seen, e.g., in FIG. 2 in which, when the element R is Nd, the ordinate intercept does not pass through the original point. The details of this will be discussed later.

The ferromagnetic fluorine compound having the above characteristics can be applied in various apparatuses including a rotary electric machine. For example, PC (personal computer) peripherals such as a spindle motor (for HDD, CD-ROM/DVD, or FDD) and a stepping motor (a magnetic pickup for CD-ROM/DVD and a head drive for FDD) are included (HDD: hard disk drive, CD: compact disk, ROM: read only memory, DVD: digital versatile disk, and FDD: floppy disk drive). As office automation equipment, a fax, a copier, a scanner, and a printer are included. For an automobile, a fuel pump, an air bag sensor, an ABS (antilock breaking system) sensor, a meter, a position control motor, and an ignition device are examples. A PC game machine with a built-in HDD or DVD, and a TV set box for downloading digital data from the internet or a cable TV are also included. As home electronics, a cellular phone, a digital camera, a video camera, an MP3 (MPEG audio layer-3) player, a PDA (personal digital assistant), and a stereo audio player are included. In addition to these, there are an air conditioner, a vacuum cleaner, and an electric power tool. Furthermore, its magnetostriction phenomena being utilized, the ferromagnetic fluorine compound can be used in a sensor or an actuator.

(First Embodiment of the Invention)

The present invention provides a magnetic material whose magnetic properties have been improved by the incorporation of the element F. In the present embodiment, a fluorination method will be discussed; but off course, fluorination can be combined with at least one of the already-known methods of hydrogenation, nitrogenization, and carbonization. It is also possible to fluorinate a parent phase which has been hydrogenated, nitrogenized or carbonized, or vice versa.

The incorporation of F into a crystal lattice of the alloy causes the p-state of the electron orbital to appear in the low energy side, making the covalent status with Fe in the crystal lattice weaker. Consequently, the volume of the crystal lattice is increased to create a geometric effect that drastically increases the magnetic moment and raises the Curie temperature. Furthermore, characteristically, an electric-field gradient at the R position in the crystal lattice is significantly changed by the existence of F.

For an alloy used in the present invention, preferably, an $R_2(Fe,T)_{17}$, $R_3(Fe,T)_{29}$, or $R(Fe,T)_{12}$ phase is used. (As mentioned before, R is a 4f transition element, and T is a 3d transition element except for Fe, or Mo, Nb or W.) These alloys are based on a $CaCu_5$ (Ca: calcium, Cu: copper) structure and distinguished by the ways they are three-dimensionally assembled. The present invention is applicable to all phases having a crystal structure based on the $CaCu_5$ structure. Thus, in a broad sense, the present invention is not limited to the $R_2(Fe,T)_{17}$, $R_3(Fe,T)_{29}$, and $R(Fe,T)_{12}$ phases but $RT_5$ and $RT_7$ phases are also included; or a more complex multicomponent system may be included. For example, at least one element among Al (aluminum), Si (silicon), and Ga (gallium) may displace at least one Fe atom constituting the alloy.

Described below is a fluorination method performed on a simple system, $Sm_2Fe_{17}$, as an example. A Sm—Fe system main-phase alloy was prepared as follows: while the vaporization of rare-earth elements being taken into account, more Sm was mixed into Fe than the stoichiometric proportion, then the mixture was resolved in a vacuum, an inert gas, or a reducing gas atmosphere to uniformize the composition. After the mixture was heat-treated to form phases, it was rapidly quenched to manufacture the alloy. The obtained alloy contains a small amount of α-Fe, which is unavoidable since $Sm_2Fe_{17}$ grows by the peritectic reaction of Fe.

The obtained $Sm_2Fe_{17}$ ingot was pulverized in an inert gas using a jet mill to make the average grain size 10 μm or smaller. A ball mill and the like may be concurrently used. In the present embodiment, the $Sm_2Fe_{17}$ magnetic powders produced in this way were heat-treated for fluorination. In addition to the above method, a liquid super-rapid quenching method may also be used in which, a main-phase alloy melted is cast and jet-quenched on the surface of a turning roll(s) such as a single roll or twin rolls in an inert gas or a reducing gas atmosphere to produce a thin ribbon for making magnetic powders. The magnetic powders manufactured in this method are characterized by having several tens to several hundreds of nm of microscopic texture.

In addition to the alloy-pulverized powders and the thin ribbon powders, a nanoparticle process or a thin film process may also be used to manufacture a main-phase alloy. For example, gas-phase methods include a thermal CVD (chemical vapor deposition) method, a plasma CVD method, a molecular beam epitaxy method, a sputter method, an EB (electron beam) evaporation method, a reactive evaporation method, a laser ablation method, and a resistance heating evaporation method. Liquid-phase methods include a coprecipitation method, a microwave heating method, a micelle method, a reverse-micelle method, a hydrothermal synthesis method, and a sol-gel method. The present invention is not to be limited by these manufacturing methods of a main-phase alloy. Of course, the parent phase to be fluorinated may be $R_2Fe_{17}$, $R_3(Fe,T)_{29}$, $R(Fe,T)_{12}$, $RT_5$, $RT_7$, etc., to which at least one of carbonization, nitrogenization, or hydrogenation has been performed. It is preferred, however, that the carbonization, nitrogenization, or hydrogenation be less than the interstitial limit amount of the element.

In the present embodiment, the thermal decomposition and sublimation of ammonium fluoride ($NH_4F$, with a solubility in water of 45.3 mg/100 ml at 25° C.) was used in the fluorination process. Besides the thermal decomposition and sublimation of ammonium fluoride, the thermal decomposition of ammonium bifluoride ($NH_4F.HF$), ammonium silicofluoride [$(NH_4F)_2SiF_6$], and ammonium fluoroborate ($NH_4BF_4$) may be utilized. When ammonium bifluoride was used in a separate fluorination experiment, it has yielded a better result in the degree of fluorination than ammonium fluoride. Presumably, it is because the ammonium bifluoride contained a large amount of F and was easier to be decomposed thermally.

Figure 6:
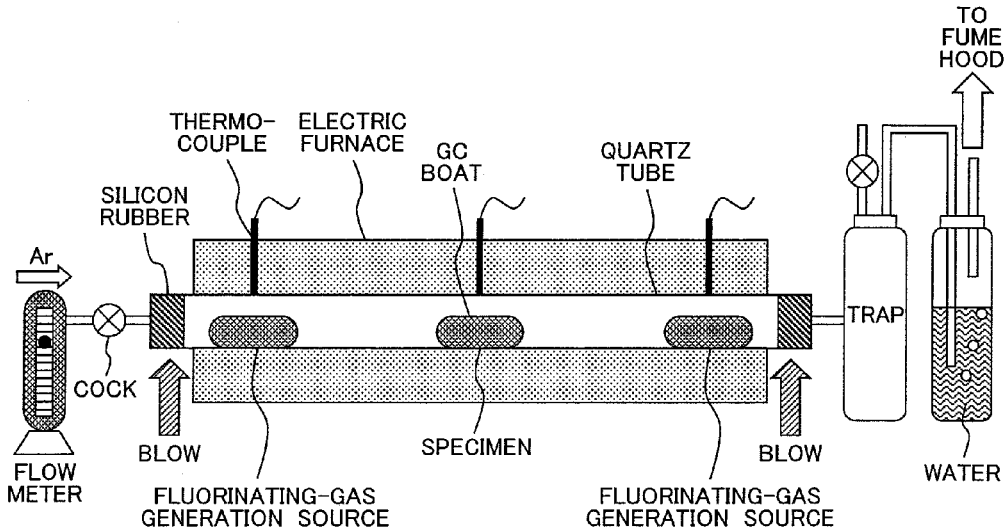
FIG. 6 is a schematic diagram illustrating a cross-sectional view of a reaction device in a laboratory, applying a thermal decomposition of a fluoride to a fluorination process in the present invention.

FIG. 6 is a schematic diagram illustrating a cross-sectional view of a reaction device in a laboratory, applying a thermal decomposition of a fluoride to a fluorination process in the present invention. A trap structure is provided to the downstream side of the reaction device to absorb extra ammonium fluoride, ammonia ($NH_3$), and hydrogen fluoride (HF) generated by thermal decomposition. A specimen (main-phase alloy powders) was thinly spread on a glassy carbon (GC) boat and disposed as shown in FIG. 6. Besides carbon, platinum or nickel may be used as a material for the specimen container. The upstream and the downstream sides of the specimen are each provided with a GC boat holding ammonium fluoride powders. The preparation amount of the ammonium fluoride depends on the size of the reaction space, the flow rate of gas to be passed, the temperature of heat treatment, and the duration of the heat treatment. In this experiment, a quartz tube with a radius of 28 mm and a length of 1200 mm was used to dispose 15 g of ammonium fluoride upstream and 5 g of ammonium fluoride downstream in relation to 3 g of magnetic powders.

After the tube had been evacuated with a rotary pump, 200 ml/min of Ar gas was passed and the electric furnace was heated. The heat treatment was performed at 150, 200, 300, and 400° C. for 1 hour of reaction time. With regard to the heat treatment temperature, the low temperature side was targeted in which, the decomposition and oxidation reaction of $Sm_2Fe_{17}$ would be relatively small. In addition, to study the influence of heat treatment time, another heat treatment was performed for 7 hours of reaction time but only at 200° C. The mass of each specimen was measured before and after the heat treatment to evaluate an increase or decrease in the mass of the specimen. The specimen may have unreacted products attached, thus it was stored in a polyethylene container in a vacuum-packaged state.

Preferably, ammonium fluoride and magnetic powders are mixed before being disposed on the GC boat to accelerate fluorination. When the mixture is used, the tube may be evacuated at the end of the heat treatment to remove any unreacted products. Since the present method involves solid-gas and low temperature reactions, it may result in an ununiform reaction. Thus, a fluidized bed or the like is preferably introduced to promote an even reaction. When the fluorinating heat temperature is 220° C. or lower, a polytetrafluoroethylene container can be used so that the fluorinating-gas generation sources and the specimen placed in the polytetrafluoroethylene container can be agitated during the reaction by a hot stirrer utilizing the magnetic properties of the specimen.

Figure 7:
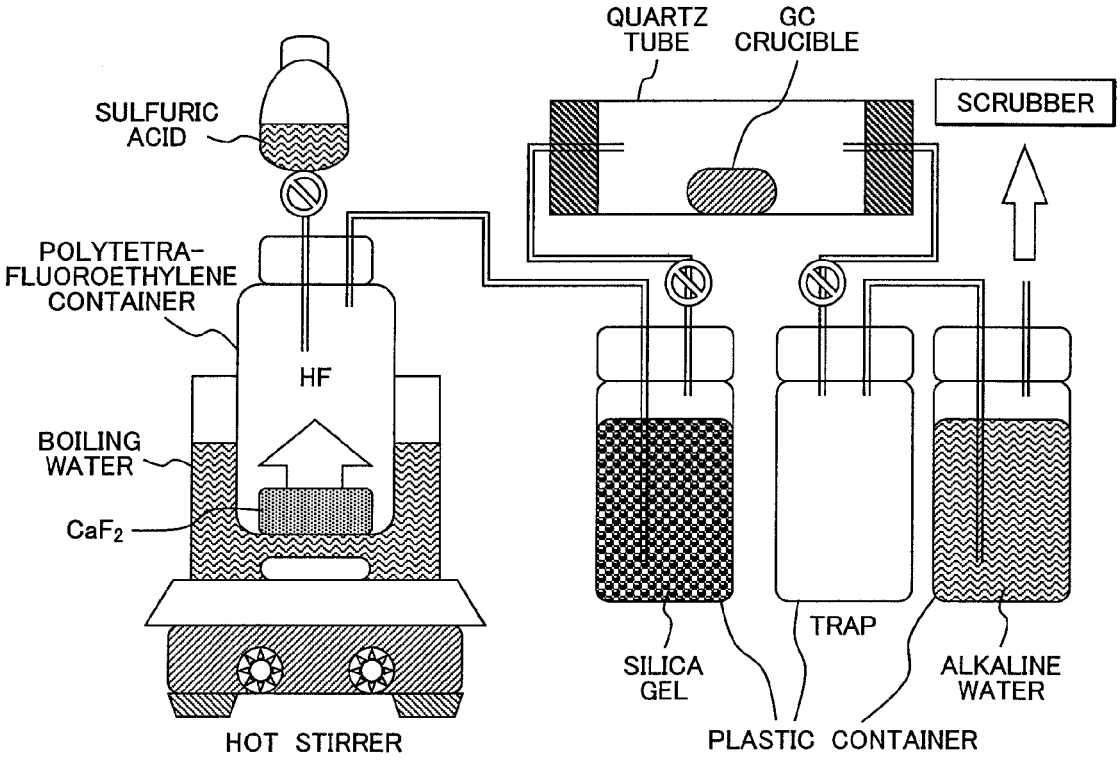
FIG. 7 is a schematic diagram illustrating a cross-sectional view of another reaction device in a laboratory, applying a fluoride gas flow to a fluorination process in the present invention.

On the other hand, a gas flow such as that of nitrogen trifluoride ($NF_3$), boron trifluoride ($BF_3$), or hydrogen fluoride (HF) may be used. For example, the following fluorination method uses HF gas generated by the reaction of calcium fluoride ($CaF_2$) and concentrated sulfuric acid ($H_2SO_4$). FIG. 7 is a schematic diagram illustrating a cross-sectional view of another reaction device in a laboratory, applying a fluoride gas flow to a fluorination process in the present invention. Sulfuric acid was dropped onto calcium fluoride in a polytetrafluoroethylene container placed on a hot stirrer to adjust the amount of HF gas generation. The HF gas was dehydrated by passing through silica gel. The specimen after the fluorination reaction was stored in a polyethylene container in a vacuum-packaged state.

As a dehydration agent, a catalyst or a molecular sieve may also be used. The fluorination was performed at room temperature in this experiment; however, as long as a mechanism to prevent the back-flow of HF gas caused by heating is installed for simultaneously passing the fluorinating gas, the specimen can be placed in an electric furnace. Since the method uses a diffusion reaction, heating is preferable to accelerate the rate of fluorination reaction. In this regard, the temperature is preferably 400° C. or lower.

(Second Embodiment of the Invention)

In the present embodiment, characteristics of the ferromagnetic fluorine compound powders prepared above will be described. FIG. 1 is graphs showing: (a) a relationship between increase rate of Curie temperature of $Sm_2Fe_{17}F_x$ and expansion rate of a-axis lattice constant thereof; and (b) a relationship between increase rate of Curie temperature of $Sm_2Fe_{17}F_x$ and expansion rate of unit-cell volume thereof. Note that the Curie temperature is defined as a polarized point in the temperature dependency curve of magnetization in a magnetic field of 0.5 tesla (T); the crystal lattice constant and the unit-cell volume are values at 20° C. As shown in FIG. 1(*a*), the Curie temperature increases with expanding the a-axis lattice constant, and has a slope of 25.2 (±5). Its ordinate intercept is 1.8 (±3). As shown in FIG. 1(*b*), the Curie temperature increases with expanding the unit-cell volume, and has a slope of 12.8 (±4). Its ordinate intercept is 1.8 (±5). Similar trends were observed in $Sm_3Fe_{28}TiF_y$ and $SmFe_{11}TiF_z$ also (Ti: titanium).

Figure 2:
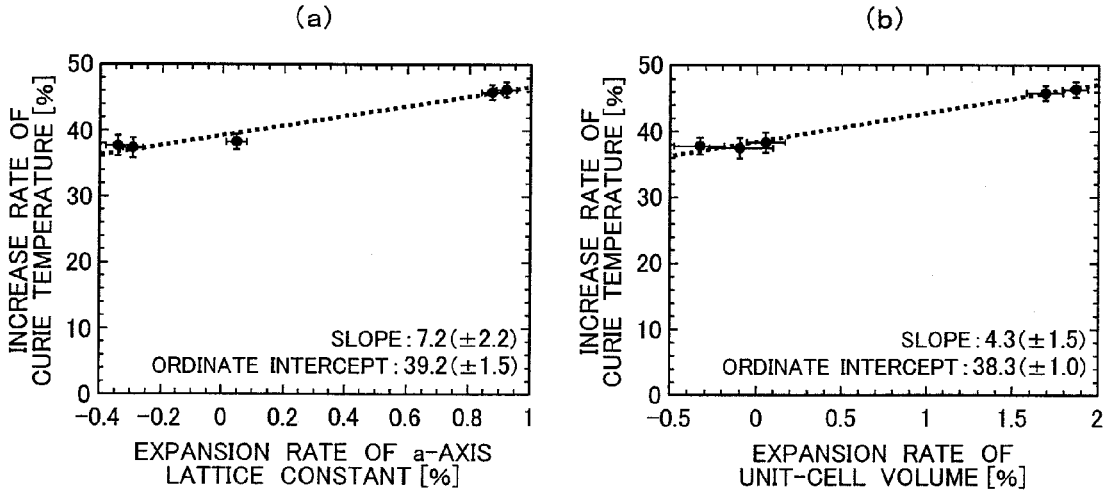
FIG. 2 is graphs showing: (a) a relationship between increase rate of Curie temperature of $Nd_2Fe_{17}F_x$ and expansion rate of a-axis lattice constant thereof; and (b) a relationship between increase rate of Curie temperature of $Nd_2Fe_{17}F_x$ and expansion rate of unit-cell volume thereof.

FIG. 2 is graphs showing: (a) a relationship between increase rate of Curie temperature of $Nd_2Fe_{17}F_x$ and expansion rate of a-axis lattice constant thereof; and (b) a relationship between increase rate of Curie temperature of $Nd_2Fe_{17}F_x$ and expansion rate of unit-cell volume thereof. Note that the Curie temperature is defined as a polarized point in the temperature dependency curve of magnetization in a magnetic field of 0.5 tesla (T); the crystal lattice constant and the unit-cell volume are values at 20° C. As shown in FIG. 2(*a*), the Curie temperature increases with expanding the a-axis lattice constant, and has a slope of 7.2 (±2.2). Its ordinate intercept is 39.2 (±1.5). As shown in FIG. 2(*b*), the Curie temperature increases with expanding the unit-cell volume, and has a slope of 4.3 (±1.5). Its ordinate intercept is also near 38.3 (±1.0). Similar trends were observed in $Nd_3Fe_{28}TiF_y$ and $NdFe_{11}TiF_z$ also.

The linear relationships shown in FIGS. 1 and 2 are mainly dependent on a change in the interatomic distance between Fe atoms caused by the intrusion of F atom into $R_2Fe_{17}$ (R=Sm or Nd) crystal lattice. Therefore, the expansion rate of a-axis lattice constant and the expansion rate of unit-cell volume are correlated with the intrusion amount of F. The ordinate intercepts show the effect of Curie temperature rise that is not dependent on crystal lattice expansion.

Generally, when each of the elements H (hydrogen), C (carbon), and N (nitrogen) incorporate into $R_2Fe_{17}$, a ratio of "[the increase rate of Curie temperature (%)]/[the expansion rate of a-axis lattice constant (%)]" is 70.7, and the ordinate intercept is −46.6; a ratio of "[the increase rate of Curie temperature (%)]/[the expansion rate of unit-cell volume (%)]" is 34.1, and the ordinate intercept is −113.3. It has been known that these values have almost no dependency on rare-earth elements. In comparison with the values of each element H, C or N, when the element F was intruded, the result characteristically showed a smaller slope and a larger ordinate intercept. This can be explained by the fact that, since the localization of Fe was promoted by the strong electronegativity of F, the effect of the localization of Fe caused by crystal lattice expansion was reduced. This is one of the characteristics of the reforms in magnetic properties caused by the intrusion of F.

When the rare-earth elements Sm and Nd are compared in the slope of the linear relationship and the ordinate intercept, $Nd_2Fe_{17}F_x$ has a smaller slope and a larger ordinate intercept than $Sm_2Fe_{17}F_x$. This is believed to be because $Nd_2Fe_{17}F_x$ has a larger crystal lattice constant than $Sm_2Fe_{17}F_x$, creating a difference in the size of spatial expansion for the interstitial position of F. It may be said that $Nd_2Fe_{17}F_x$ has a greater effect than $Sm_2Fe_{17}F_x$ in the localization of Fe caused by the strong electronegativity of F. Theoretically, the correlation such as above is expected to be observed in $R_2(Fe,T)_{17}F_x$, $R_3(Fe,T)_{29}F_y$, and $R(Fe,T)_{12}F_z$ also.

Figure 3:
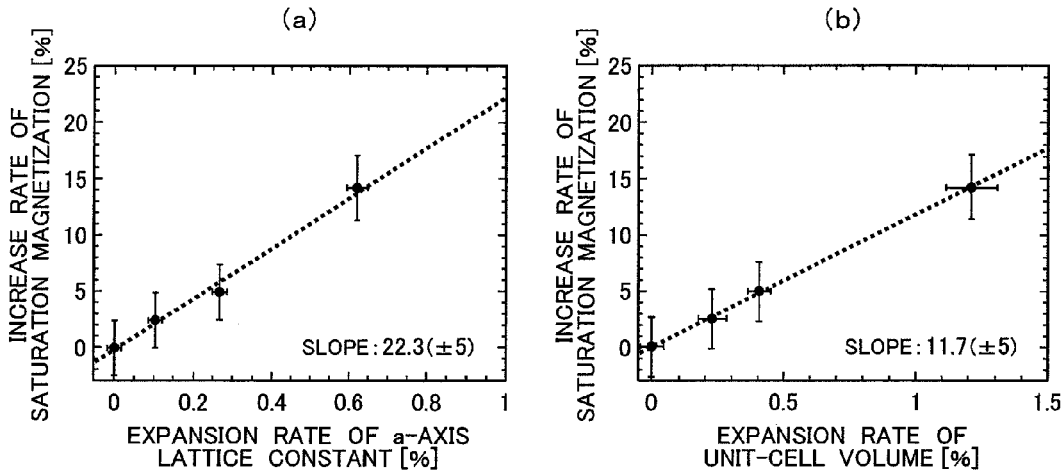
FIG. 3 is graphs showing: (a) a relationship between increase rate of saturation magnetization per unit mass of $Sm_2Fe_{17}F_x$ at 17° C. and expansion rate of a-axis lattice constant thereof; and (b) a relationship between increase rate of saturation magnetization per unit mass of $Sm_2Fe_{17}F_x$ at 17° C. and expansion rate of unit-cell volume thereof.

FIG. 3 is graphs showing: (a) a relationship between increase rate of saturation magnetization per unit mass of $Sm_2Fe_{17}F_x$ at 17° C. and expansion rate of a-axis lattice constant thereof; and (b) a relationship between increase rate of saturation magnetization per unit mass of $Sm_2Fe_{17}F_x$ at 17° C. and expansion rate of unit-cell volume thereof. Note that the crystal lattice constant and the unit-cell volume were measured at 20° C. As shown in FIG. 3(*a*), the saturation magnetization increases with expanding the a-axis lattice constant, and has a slope of 22.3 (±5). The ordinate intercept is 0 (±2). As shown in FIG. 3(*b*), the saturation magnetization increases with expanding the unit-cell volume, and has a slope of 11.7 (±5). The ordinate intercept is 0 (±3). These slopes are related to a rise in the Curie temperature, a change in magnetic anisotropy, and an increase in a magnetic moment. In a range where the intrusion amount of F is relatively small and the expansion rates of a-axis lattice constant and unit-cell volume are relatively small, the relationship is linear. However, we are not sure whether the linear relationship will be kept or not when the intrusion amount of F is extremely increased. Such a tendency of an increase in saturation magnetization was observed in $Nd_2Fe_{17}F_x$, $Sm_3Fe_{28}TiF_y$, $SmFe_{11}TiF_z$, $Nd_3Fe_{28}TiF_y$, and $NdFe_{11}TiF_z$ also; and theoretically, expected to be observed in $R_2(Fe,T)_{17}F_x$, $R_3(Fe,T)_{29}F_y$, and $R(Fe,T)_{12}F_z$.

Figure 4:
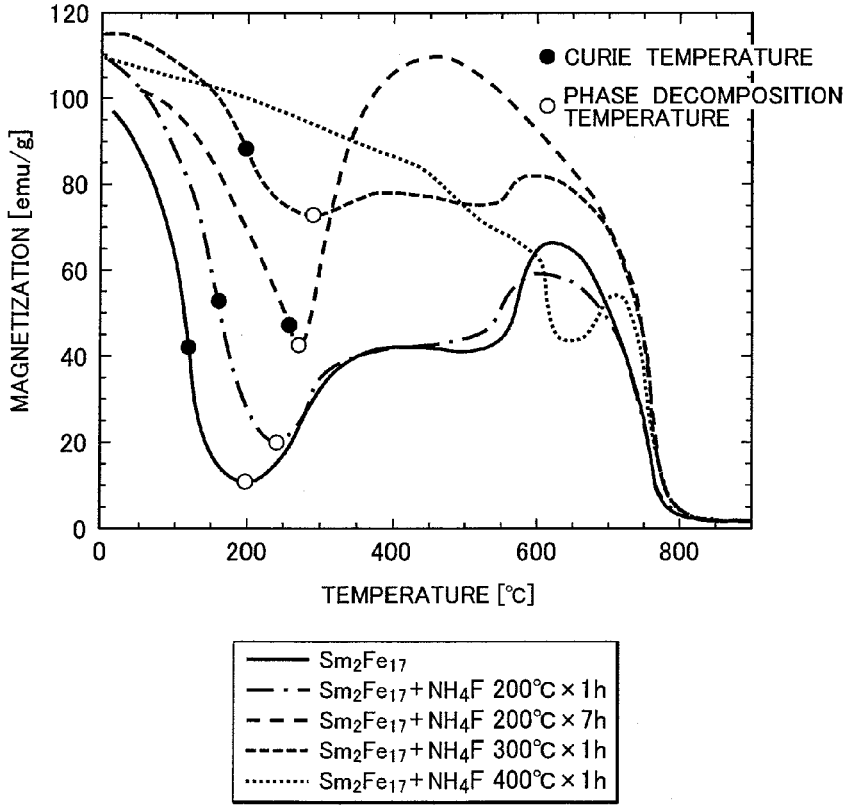
FIG. 4 is a graph showing a relationship between ambience temperature and magnetization in a magnetic field of 0.5 tesla (T) of $Sm_2Fe_{17}$ heat-treated for fluorination.

FIG. 4 is a graph showing a relationship between ambience temperature and magnetization in a magnetic field of 0.5 tesla (T) of $Sm_2Fe_{17}$ heat-treated for fluorination. After a tube including the specimen has been evacuated to $5.0\times10^{-5}$ torr or lower with a turbo-molecular pump, it was displaced with He (helium) gas. Measurements were taken during a temperature rising process from 20 to 890° C. The time constant of a lock-in amplifier of a VSM (vibrating sample magnetometer) was set to 1 second, and a measurement was taken under the condition of a temperature rising rate of 5° C./rain. A rapid increase in magnetization at high temperatures has been known to be observed in oxygen and hydrogen atmospheres, which is due to a large amount of Fe generated by phase decomposition. The rapid increase in magnetization at high temperatures as shown in FIG. 4 is believed to be because oxygen was mixed in during the He gas displacement or hydrogen was generated by unreacted products. For this reason, the rapid increase in magnetization at high temperatures is varied depending on the concentration of oxygen and hydrogen. Thus, a phase-decomposition temperature is defined at a minimal value.

The experimental results have shown that the Curie temperature of the parent phase increased with increasing fluorinating heat-treatment temperature up to 300° C. Magnetization did not become zero at temperatures higher than the Curie temperature because α-Fe (its Curie temperature is approximately 770° C.) was contained. An allot plot method has been known for identifying Curie temperature; however, in the present invention, the temperature of a polarized point on the temperature dependency of magnetization is defined as the Curie temperature. For this reason, the absolute value of the Curie temperature slightly changes depending on the relative amount of a contained phase. Furthermore, a range of temperatures at which the magnetization precipitously increases was observed to rise as the Curie temperature rises. This means an increase in phase decomposition temperature. It has become clear that the phase decomposition temperature is 20 to 120° C. higher than the Curie temperature.

Figure 5:
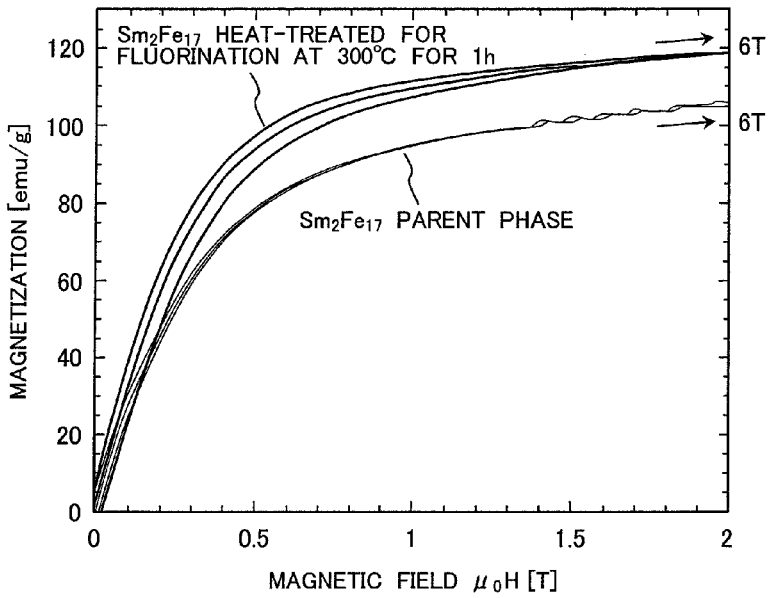
FIG. 5 is a graph showing a relationship between external magnetic field and magnetization at 25° C. of $Sm_2Fe_{17}$ and $Sm_2Fe_{17}$ heat-treated for fluorination at 300° C. for 1 hour.

FIG. 5 is a graph showing a relationship between external magnetic field and magnetization at 25° C. of $Sm_2Fe_{17}$ and $Sm_2Fe_{17}$ heat-treated for fluorination at 300° C. for 1 hour. Note that an initial magnetization curve thereof is also shown, and a magnetic field of 6 tesla (T) at maximum was applied. The magnetic powders were placed in a plastic capsule and fixed with adhesive to prevent the powders from turning in the magnetic field. No hysteresis (i.e., difference in a magnetization curve between excitation and degaussing) was shown in the magnetization curve of $Sm_2Fe_{17}$ in the parent phase, reflecting that the axis of easy magnetization was in the a-b plane of crystal. On the other hand, the magnetization curve for $Sm_2Fe_{17}$ heat-treated for fluorination at 300° C. for 1 hour exhibited hysteresis, suggesting that the axis of easy magnetization was the c-axis of crystal. The average grain size of the magnetic powders used in the measurement was 10 μm so that their coercivity was not great; however, a significant amount of coercivity will presumably be generated by pulverizing the powders to roughly 2 to 3 μm. The magnetic anisotropy of $Sm_2Fe_{17}$ was changed from in-plane anisotropy to uniaxial anisotropy through fluorination, showing a possibility for the alloy to be used as a permanent magnet material. This is because the 4f electric orbital responsible for the magnetism of Sm element is cigar-shaped, and a similar effect is expected in Er and Tm elements. That is, in consideration of a crystal field acting on a rare-earth element, when the rare-earth element R is Sm, Er, or Tm, given that $R_2(Fe,T)_{17}F_x$ ($0<x\leq3$) and $R_3(Fe,T)_{29}F_y$ ($0<y\leq4$), uniaxial anisotropy is obtained. On the other hand, given that $R(Fe,T)_{12}F_z$ ($0<z\leq1$), when the rare-earth element R is Pr, Nb, Tb, or Dy, uniaxial anisotropy is obtained.

In addition, $Sm_2Fe_{17}$ is decomposed along with the fluorination process, and the resulting α-Fe tends to be found more on the surface of the magnetic powders. Consequently, it contributes as a reverse magnetic domain nucleus during magnetization reversal, thus Zn and the like is preferably mixed in to form a paramagnetic phase such as a Zn—Fe alloy.

Figure 8:
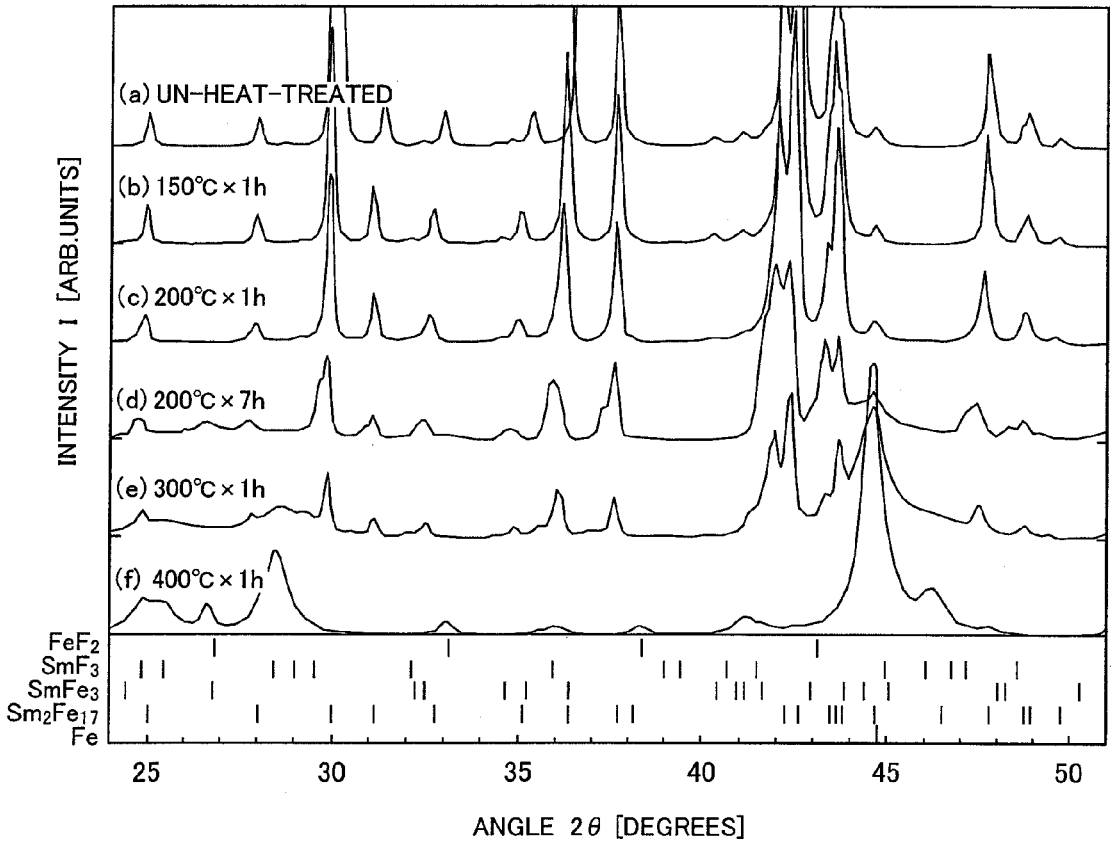
FIG. 8 shows powder X-ray diffraction patterns of $Sm_2Fe_{17}$ in: (a) un-heat-treated powders; (b) powders fluorination heat-treated at 150° C. for 1 hour; (c) powders fluorination heat-treated at 200° C. for 1 hour; (d) powders fluorination heat-treated at 200° C. for 7 hours; (e) powders fluorination heat-treated at 300° C. for 1 hour; and (f) powders fluorination heat-treated at 400° C. for 1 hour.

FIG. 8 shows powder X-ray diffraction patterns of $Sm_2Fe_{17}$ in: (a) un-heat-treated powders; (b) powders fluorination heat-treated at 150° C. for 1 hour; (c) powders fluorination heat-treated at 200° C. for 1 hour; (d) powders fluorination heat-treated at 200° C. for 7 hours; (e) powders fluorination heat-treated at 300° C. for 1 hour; and (f) powders fluorination heat-treated at 400° C. for 1 hour. Note that these measurements were carried out at 20° C., and the diffraction peak patterns of metals and compounds used for identifying the obtained products are shown in the lower portion of the figure.

FIG. 8(*a*) shows that, in the un-heat-treated powders, a slight amount of Fe and $SmFe_3$ (a $Ni_3Pu$ type, space group R-3m) was mixed in besides $Sm_2Fe_{17}$ of the main phase. In FIGS. 8(*b*) and 8(*c*), approximately the same diffraction patterns as the un-heat-treated powders in FIG. 8(*a*) were observed in the powders fluorination heat-treated at (*b*) 150°

C. for 1 hour and (*c*) 200° C. for 1 hour, showing that similar phases were mixed in. In FIG. 8(*d*), the powders fluorination heat-treated at 200° C. for 7 hours have shown that the peak width of $Sm_2Fe_{17}$ was extended as well as the peak was expanded to a wider range. This means that $Sm_2Fe_{17}$ was being transformed into a short-range structure such as an amorphous structure because the heat-treatment time was extended. The decomposition of $Sm_2Fe_{17}$ progressed, and Fe generation was observed; and in addition, the presence of a small amount of $FeF_2$ (a rutile type, space group $P4_2/mnm$) was observed. In the powders fluorination heat-treated at 300° C. for 1 hour in FIG. 8(*e*), the presence of amorphous structures more than the powders fluorination heat-treated at 200° C. for 7 hours in FIG. 8(*d*) is noticeable; however, the main peak still has the same symmetry as $Sm_2Fe_{17}$. Moreover, it suggests that a massive amount of Fe was generated. In the powders fluorination heat-treated at 400° C. for 1 hour in FIG. 8(*f*), mainly Fe was observed in addition to $Sm_2Fe_{17}$, $FeF_2$, and $SmF_3$. At a fluorinating heat-treatment temperature of 400° C., $Sm_2Fe_{17}$ was changed to another phase. Furthermore, it was observed that, as the fluorinating heat-treatment temperature increased, the peak of $Sm_2Fe_{17}$ was shifted to the low-angle side, meaning that the crystal lattice was expanding. Presumably, a small difference in the relative peak intensity is related not only to the orientation of the magnetic powders but also to a change in the special position of an atom in a unit-cell. It is unavoidable for a small amount of Fe to be generated during the fluorination since the $Sm_2Fe_{17}$ phase is un-uniformized; consequently, the fluorinated phase contains Fe, $FeF_2$, and $FeF_3$.

Figure 9:
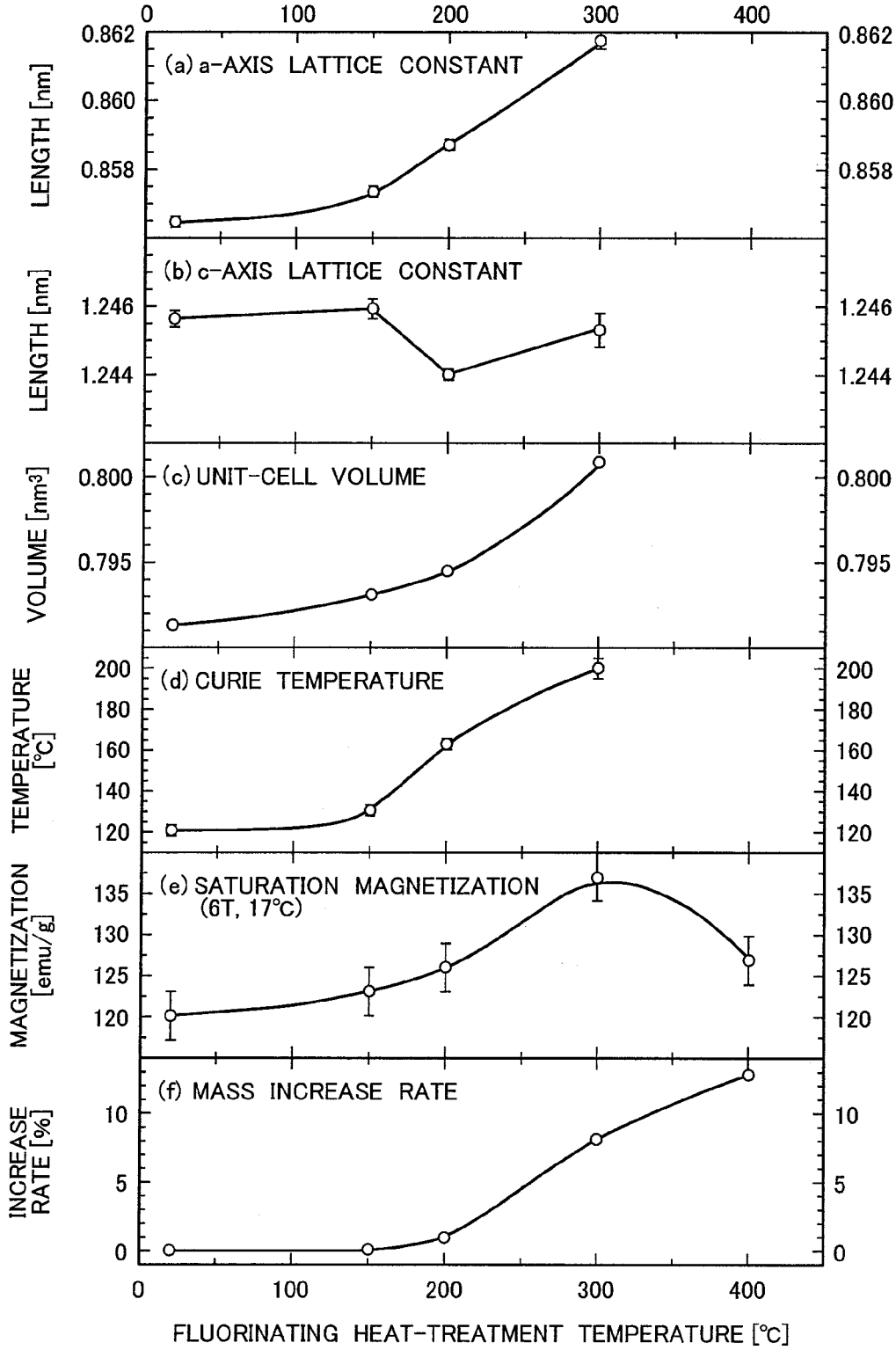
FIG. 9 is a graph showing relationships in $Sm_2Fe_{17}F_x$ between fluorinating heat-treatment temperature for $Sm_2Fe_{17}$ and: (a) a-axis lattice constant; (b) c-axis lattice constant; (c) unit-cell volume; (d) Curie temperature; (e) saturation magnetization; and (f) mass increase rate thereof.

FIG. 9 is a graph showing relationships in $Sm_2Fe_{17}F_x$ between fluorinating heat-treatment temperature for $Sm_2Fe_{17}$ and: (a) a-axis lattice constant; (b) c-axis lattice constant; (c) unit-cell volume; (d) Curie temperature; (e) saturation magnetization; and (f) mass increase rate thereof. The lattice constant was assumed to have the same symmetry as $Sm_2Fe_{17}$ in FIG. 8 to be indexed for derivation, and the unit-cell (rhombohedral) volume was derived using the lattice constant. The Curie temperature was derived from FIG. 4. Consequently, the absolute value would be slightly varied according to the relative amount of a mixed phase. The saturation magnetization was derived by obtaining the average magnetization per unit mass in a magnetic-field range of 5.4 to 6.0 tesla (T) at 17° C. Magnetic powders were not fixed with adhesive to allow free rotation of the magnetic powders by the magnetic field. The mass increase rate is a rate of mass increase obtained by checking the mass before and after the fluorinating heat-treatment.

In FIG. 9(*a*) showing the dependency of the a-axis lattice constant on the fluorinating heat-treatment temperature, the a-axis lattice constant increased with increasing the temperature; but FIG. 9(*b*) showing the dependency of the c-axis lattice constant on the fluorinating heat-treatment temperature has shown almost no change in the constant although it was reduced at 200° C. Although the c-axis lattice constant has exhibited almost no change under the heat-treatment condition of this experiment, it may possibly change as the intrusion amount of F increases. FIG. 9(*c*) has shown that the unit-cell volume was simply increased, corresponding to the increase in the crystal lattice constant of the a-axis. FIG. 9(*d*) has shown that the Curie temperature rose with increasing the unit-cell volume. In FIG. 9(*e*) showing the dependency of saturation magnetization on the fluorinating heat-treatment temperature, the saturation magnetization increased in a temperature range from room temperature to 300° C., then decreased at a temperature of 400° C. Regardless of a large amount of Fe generated by the decomposition of $Sm_2Fe_{17}$ at fluorinating heat-treatment temperature of 400° C., saturation magnetization per unit mass was still decreased. This is related to the point that the fluorinating heat treatment at 300° C. or below caused the magnetic moment of $Sm_2Fe_{17}$ as the parent phase to be increased, in-plane magnetic anisotropy to be changed to uniaxial magnetic anisotropy, or the Curie temperature to be increased; but it is also related to a change in the relative rate between ferromagnetic and paramagnetic phases since $SmF_3$ and $FeF_2$ (a small amount of $FeF_3$) are paramagnetic at 17° C.

Figure 10:
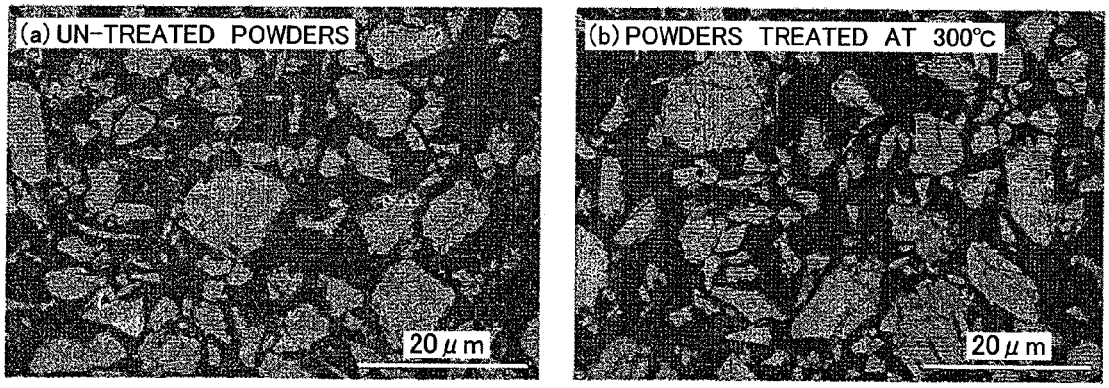
FIG. 10 shows SEM images of cross-sectional shape of $Sm_2Fe_{17}$ crystal grains in: (a) un-heat-treated powders; and (b) powders heat-treated for fluorination at 300° C.

FIG. 10 shows SEM (scanning electron microscopy) images of cross-sectional shape of $Sm_2Fe_{17}$ crystal grains in: (a) un-heat-treated powders; and (b) powders heat-treated for fluorination at 300° C. The size and the shape of the crystal grains have shown no particular change after the reaction.

Figure 11:
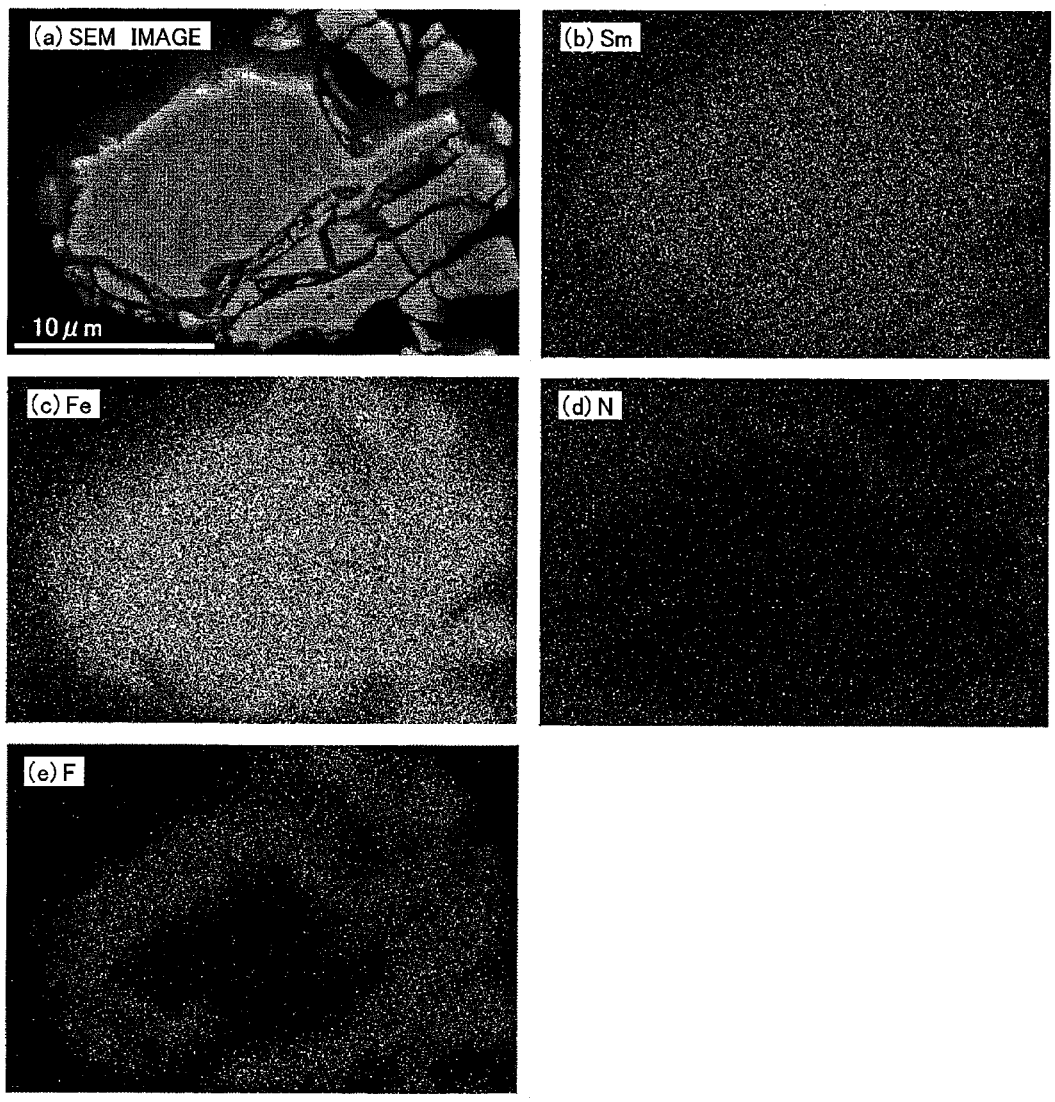
FIG. 11 shows an SEM image of (a) cross-sectional shape of $Sm_2Fe_{17}$ powders heat-treated for fluorination at 300° C. for 1 hour, and WDS element mapping images thereof in: (b) Sm; (c) Fe; (d) N; and (e) F.

FIG. 11 shows an SEM image of (a) cross-sectional shape of $Sm_2Fe_{17}$ powders heat-treated for fluorination at 300° C. for 1 hour, and WDS element mapping images thereof in: (b) Sm; (c) Fe; (d) N; and (e) F. An SEM-WDS (scanning electron microscopy-wavelength dispersive X-ray fluorescence spectrometer) was used for observation. The WDS is characterized by having a high resolution for fluorescent X-ray signals, thus there is no interference of a signal of the other element. As described above, the SEM image in FIG. 11(*a*) has shown the presence of many crystal grains having a diameter of approximately 10 μm, and no significant change in the grain shape after the fluorination process. The WDS element mapping images of FIGS. 11(*b*) and 11(*c*) suggest that the crystal grains were made up of Sm and Fe. In consideration of the powder X-ray diffraction result (see FIG. 8(*e*)), the crystal grains are assumed to be $Sm_2Fe_{17}$. The WDS element mapping image of FIG. 11(*d*) N has shown that N element was distributed more in an embedded resin portion outside the crystal grains, and was in the grains in a concentration not exceeding the detection limit. The WDS element mapping image of FIG. 11(*e*) F has indicated that F element was distributed more in the crystal grains having the $Sm_2Fe_{17}$ structure. As a result, it was made clear that not N but F element has been incorporated into the crystal grains of $Sm_2Fe_{17}$. The reason for the F element to be distributed more in the peripheral portion of the crystal grains is assumed to be that, since the fluorinating heat treatment was achieved by a solid-gas reaction, the F atoms were absorbed from the peripheral portion of the crystal grains. The treatment time can be extended to allow fluorination to advance to the inside. Since the F atoms intrude into and diffuse from the peripheral portion of the crystal grains, the fluorine concentration consequently has a concentration gradient from the crystal grain boundaries toward the center of the parent phase.

From the results above, it can be concluded that the $Sm_2Fe_{17}F_x$ composition and structure with F disposed to its interstitial position were synthesized by fluorinating and heat-treating $Sm_2Fe_{17}$ using the thermal decomposition of $NH_4F$. The composition and structure of $Sm_3Fe_{28}TiF_y$ and $SmFe_{11}TiF_z$ were confirmed in the same manner. This allows the conclusion that more generally, $R_2(Fe,T)_{17}F_x$, $R_3(Fe,T)_{29}F_y$, and $R(Fe,T)_{12}F_z$ exist as a phase.

Figure 12:
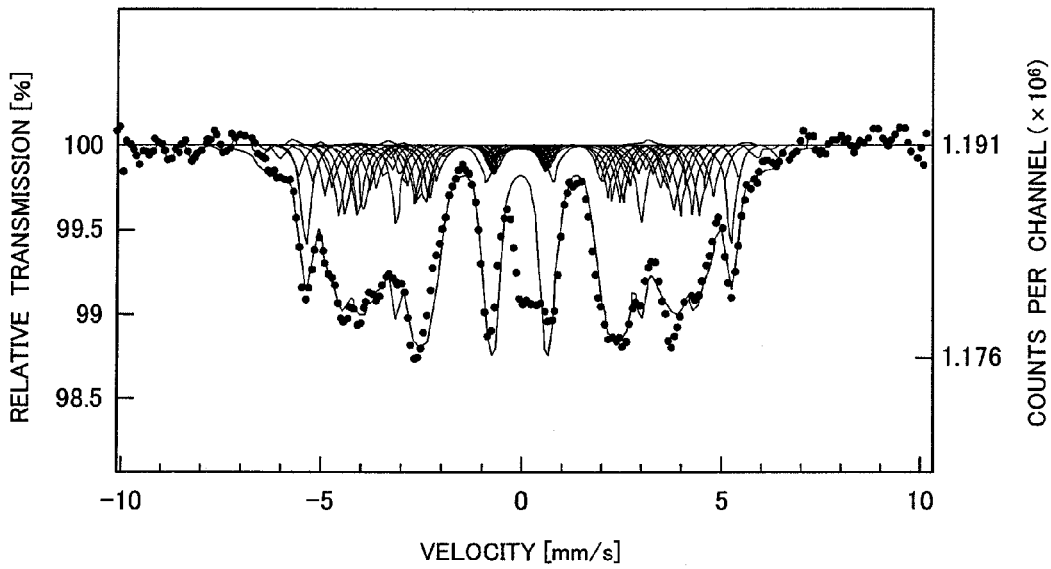
FIG. 12 shows Mossbauer spectra, at room temperature, of $Sm_2Fe_{17}$ heat-treated for fluorination at 200° C. for 7 hours.

FIG. 12 shows Mossbauer spectra, at room temperature, of $Sm_2Fe_{17}$ heat-treated for fluorination at 200° C. for 7 hours. The overall shape of the spectra showed distinguished magnetic splitting into 6 components, and since the full widths at half maximum of the 2 inner components of the 6 (magnetic splitting) were narrow while those of the outer components were wide, it was assumed to be the sum of components having a plurality of internal magnetic fields. Thus, an analysis was performed on the assumption of "a model having an internal magnetic field distribution". That is, multiple components having a relative intensity rate of the full width at half maximum and the magnetic splitting of a pure iron standard sample, having a zero isomer shift and a zero quadrupole splitting, but having internal magnetic fields which are different from each other, are assumed, and the composition of the components is directly substituted with a probability density to obtain a pseudo-distribution of internal magnetic fields. In the internal magnetic field distribution, strong peaks were observed near 250 (kOe), 275 (kOe), and 330 (kOe), weak peaks were observed near 220 (kOe) and 300 (kOe), and furthermore, very weak peaks were observed near 360 (kOe).

(Third Embodiment of the Invention)

Figure 13:
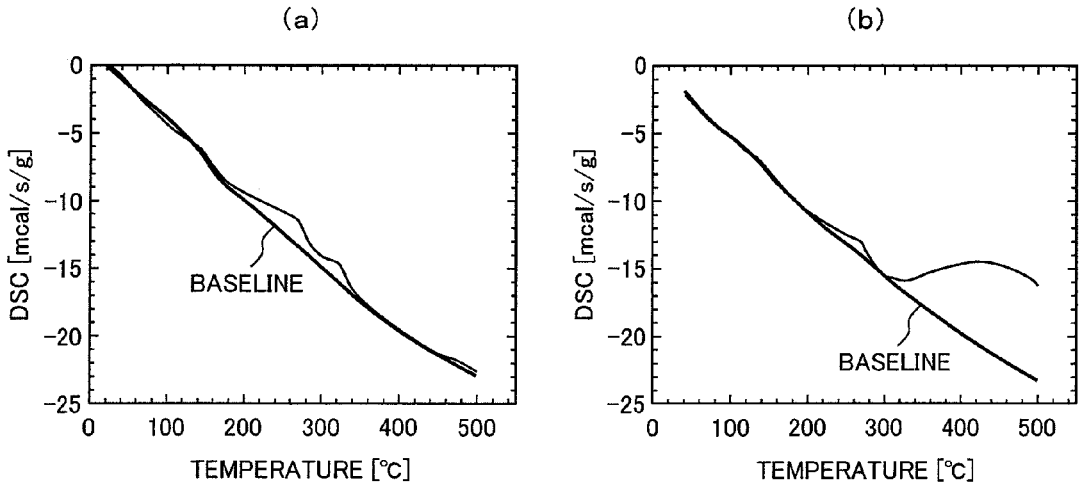
FIG. 13 shows results of DSC measurements of $Sm_2Fe_{17}$ in: (a) Ar atmosphere; and (b) $N_2$ atmosphere.

In the present embodiment, temperatures for the fluorinating heat treatment will be described. Appropriate temperatures for the fluorinating heat treatment can be estimated to some extent from DSC (differential scanning calorimetry) characteristics. FIG. 13 shows results of DSC measurements of $Sm_2Fe_{17}$ in: (a) Ar atmosphere; and (b) $N_2$ atmosphere. The figure shows two distinctive exothermic reactions in both Ar and $N_2$ atmospheres. Since the second exothermic reaction was large and kept on at high temperatures in the $N_2$ atmosphere, it is assumed to be corresponding to the reaction of the intrusion of the N atoms into a $Sm_2Fe_{17}$ crystal lattice. In the first embodiment, the fluorinating heat treatment exhibited good characteristics until 300° C., but at a fluorinating heat-treatment temperature of 400° C., almost no $Sm_2Fe_{17}$ structure was observed. For this reason, the heat-treatment temperature for fluorination is preferably lower than 400° C., and more preferably, it is 350° C. or lower, which is when the second exothermic reaction of the DSC characteristics in the Ar atmosphere is completed.

Figure 14:
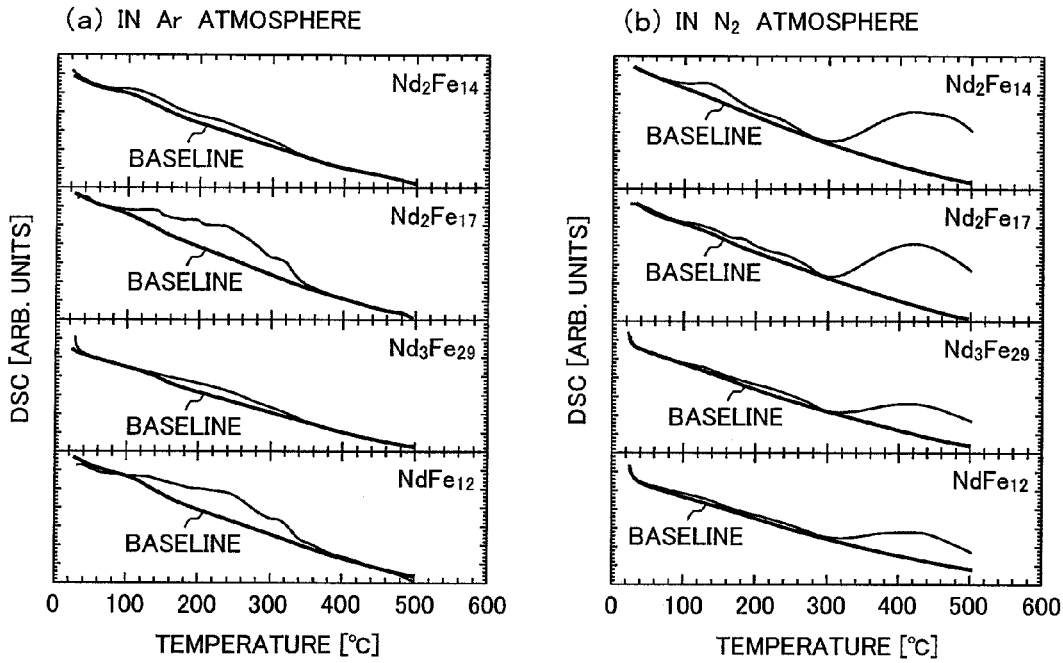
FIG. 14 shows results of DSC measurements of $Nd_2Fe_{14}$, $Nd_2Fe_{17}$, $Nd_3Fe_{29}$ and $NdFe_{12}$ in: (a) Ar atmosphere; and (b) $N_2$ atmosphere.

Based on this knowledge, fluorinating heat-treatment temperatures for the other compositions can be estimated. For example, FIG. 14 shows results of DSC measurements of $Nd_2Fe_{14}$, $Nd_2Fe_{17}$, $Nd_3Fe_{29}$, and $NdFe_{12}$ in: (a) Ar atmosphere; and (b) $N_2$ atmosphere. Note that these compositions, except for $Nd_2Fe_{17}$, are not an ordered crystal lattice, thus the compositions only reflect a ratio between the amounts of the rare-earth element and Fe element at the time of manufacturing. The magnetic powders used here were not heat-treated sufficiently for uniformization so that the oxidation and hydroxylation products of Nd and α-Fe were found in addition to the $Nd_2Fe_{17}$ phase. In all the compositions, the exothermic reaction in the Ar atmosphere converged at 350° C. or below, as shown in FIG. 14(*a*); and in the $N_2$ atmosphere, the exothermic reaction assumed to be the reaction of the intrusion of N appeared in the vicinity of 300° C., as shown in FIG. 14(*b*). Consequently, it can be estimated that the fluorinating heat-treatment temperature is preferably at 350° C. or below for any of these compositions. Taking it further, it can be estimated that the fluorinating heat-treatment temperature is preferably at 350° C. or below for rare-earth elements not limited to Sm and Nd, and furthermore, a fluorination temperature of 350° C. or below is preferable for 4f transition metal-3d transition metal alloys.

(Fourth Embodiment of the Invention)

A method for manufacturing magnetic powders for a bond magnet, using the ferromagnetic fluorine compound according to the present invention will be discussed. Naturally, hybrid magnet powders consisting of the ferromagnetic fluorine compound and the other phases or compounds are included.

(1) Preparation of Parent-Phase Alloy:

The present invention, as shown in the first embodiment, used magnetic powders containing 4f-3d transition elements in the parent phase, which magnetic powders were obtained by rapidly-quenching a composition-adjusted parent alloy and pulverizing the resulting thin ribbon of the Sm—Fe system. The Sm—Fe system parent alloy was mixed from Sm and Fe and resolved in a vacuum, an inert gas, or a reducing gas atmosphere to uniformize the composition (a melting and casting method). The parent alloy obtained was coarsely pulverized in an inert gas using a ball mill to make the average grain size approximately 10 μm.

In addition to the above method, another economical method is a reduction-diffusion method in which, samarium oxide powders and iron powders are mixed with granular metallic calcium and heated in an inert gas atmosphere for reaction. In this method, diffusion reaction is allowed at a peritectic temperature of $Sm_2Fe_{17}$ or below, and at the same time, the grain size of iron powders can be selected to control the distance of Sm diffusion in some degree, so that a single-phase alloy having a smaller amount of remaining α-Fe phase can be easily manufactured, eliminating the need of uniformizing heat-treatment which is necessary in the melting and casting method. Since the $Sm_2Fe_{17}$ alloy can be directly obtained as powders, no coarsely-pulverizing process is necessary either. In addition, for the purpose of obtaining raw powders having a smaller grain size, the hydroxide of Sm and Fe from a sulfuric acid solution may be co-precipitated and air-burned to make microcrystal oxide. Magnetic powders having a grain diameter of a few μm can be manufactured without pulverization.

On the other hand, magnetic powders for a nanocomposite magnet require a rapidly-quenched thin ribbon having a grain diameter of several μm to several tens of μm, constituting of multiple crystallites each having a crystallite diameter of several tens to several hundreds of nm. A parent alloy is cut as necessary for a method using a single roll or twin rolls, melted and cast on the surface of the turning roll(s) to be jet-quenched by an inert gas such as Ar gas or by a reducing gas atmosphere. An HDDR (hydrogenation decomposition desorption recombination) method is also useful as a method for obtaining a fine alloy powder.

The parent alloy and parent alloy powders obtained by the above methods may be coarsely pulverized as necessary. One method to do this is, e.g., mechanically pulverizing by a ball mill or a jet mill in an inert gas atmosphere or a reducing gas atmosphere. The HDDR method is also effective.

(2) Fluorination Process:

In the present invention, for example, hydrogen fluoride gas and ammonium gas generated by the thermal decomposition of ammonium fluoride described in the first embodiment were used for fluorinating heat treatment at 300° C. for 1 hour.

As a fluorination method for incorporating fluorine into the parent alloy, those methods described in the first embodiment are available; in each of which methods, gas is used for fluorination. Therefore, it is important in the fluorination process that the surface of powders to be fluorinated be evenly exposed to the gas to produce a uniform $Sm_2Fe_{17}F_x$ phase. A preferable manufacturing method is a fluidized fluorination method in which, the powders are moved through a fluidized bed. Further, the fluorination reaction is diffusion-controlled so that the smaller the grain size of powders is, the faster the fluorination will be. However, when the grain size is too small, stable fluidization is impossible, which sets a natural limit. A grain diameter of 10 μm to several hundreds of μm is appropriate when using the fluidized bed.

The decomposition reaction of a parent phase limits the fluorination process to be performed at temperatures lower than 400° C., thus the fluorination temperature cannot be increased to improve the fluorination rate. In addition, pressurization is not an option to improve the fluorination rate either due to the diffusion-controlled characteristic of the fluorination process. However, it may be possible to raise the fluorination temperature to some extent while pressurizing the powders to keep the decomposition down. Since microcrack formation caused by hydrogenation helps fluorination, mixing of hydrogen and fluoride gas is effective. Heat treatment in an inert gas atmosphere after fluorination is effective to uniformize the distribution of fluorine concentration in the powders.

(3) Pulverization Process:

In order to produce coercitivity effectively, the coarse powders obtained by the fluorination process need to be pulverized to an average grain diameter of 2 to 3 μm using a jet mill or a ball mill. In principle, the powders are preferably pulverized to a supercritical grain diameter; however, there is a lower limit due to an oxidation concern. Since the grain size of pulverized powders is very small, the surface of the grains may need to be inactivated by various methods. On the other hand, although nanocomposite magnetic powders can produce coercitivity without pulverization, their grain diameter may be of concern when being formed into a piece of magnet; the powders may require pulverization.

(Fifth Embodiment of the Invention)

Next, a method for manufacturing a bond magnet using the magnetic powders for a bond magnet, made of the ferromagnetic fluorine compound according to the present invention will be discussed. Naturally, a hybrid magnet consisting of the ferromagnetic fluorine compound magnetic powders and the other magnetic powders are included.

(4) Binder:

A binder for solidifying the magnetic powders may be low-melting-point metals or resins. The resins include a thermo-setting resin and a thermoplastic resin. As a thermosetting resin, e.g., an EP (epoxy) resin may be used; as a thermoplastic resin, e.g., a PA (polyamide or nylon) resin and a PPS (polyphenylene sulfide) resin; and as an elastomer, e.g., an NBR (acrylonitrile-butadiene rubber), a CPE (chlorinated polyethylene) resin, and an EVA (ethylene vinyl acetate) resin may be used. Inorganic compounds may also be used for solidification, and a method in which, $CH_3O—[Si(CH_3O)_2—O]_m—CH_3$ (m is 3 to 5, and the average is 4) which is a $SiO_2$ precursor solution, water, dehydrated methyl alcohol, and dibutyltin dilaurate are mixed and impregnated for solidification, may also be used.

(5) Forming Method:

When a bond magnet is manufactured by using isotropic magnetic powders, the method of productively increase the density is important. In principle, the formation of a compact, although it may depend on the magnetization properties of the magnet powders also, allows a given magnetization and a necessary magnetization pattern. On the other hand, a concern about the orientation of the magnetic powders arises when anisotropic magnetic powders are used to manufacture a bond magnet. When forming the magnet, it is important to orient the crystal axis of grains to the target direction to increase the density in the same manner as in an isotropic magnet.

A magnetization reversal mechanism is roughly classified into a nucleation type or a pinning type. In the former case, the smaller the crystal grain size is, the better the coercitivity will be; and in the latter case, the coercitivity is determined by the shape or the number of pinning sites. The ferromagnetic fluorine compounds according to the present invention are expected to have both magnetic reversal mechanisms depending on the manufacturing methods. It is believed that the coercitivity is mainly determined by the nucleation type when a crystal structure of a few μm was obtained by rapid quenching, and by the pinning type when a crystallite structure of several tens to several hundreds of nm was obtained by liquid super-rapid quenching. When the magnetic powders have shape anisotropy, the orientation of the magnetic powders during the magnet formation is important to increase the coercitivity. Generally, it is preferred that the magnet be formed so that the direction having a small demagnetization factor (a large permeance coefficient) is set to the magnetization direction.

(6) Manufacturing Process for Magnet:

As a manufacturing process for a magnet, compression molding and injection molding are available. Compression molding allows the density of magnetic powders to be increased so that a high energy product can be achieved. For example, the magnetic powders for a bond magnet, made of the ferromagnetic fluorine compound, as a raw material and an EP resin are kneaded together with an additive to make a compound, which is poured into a metallic mold for press molding. Then, after it is hardened by heat, extra powders are cleaned away before surface coating. The key points in manufacturing the compound are: the selection of powder grains; the surface processing of the powder grains; the selection of a resin; and the selection of kneading conditions. The distribution of grain diameters can be optimized to increase the density. Furthermore, using a liquid resin is effective to increase the slipperiness among the magnetic powders, increasing the density. In addition, when anisotropic magnet powders are used, the application of a magnetic field is added to orient the magnet powders. The degree of orientation will be different depending on the kind of resins used, and it is important that individual magnet powder be allowed to move freely, overcoming the viscosity of the binder during the application of the magnetic field.

The injection molding is characterized by the fact that a complicated form can be formed without post-processing. A PA resin or a PPS resin is used as a binder. For example, bond magnet powders made of the ferromagnetic fluorine compound, as a raw material, and a PA or a PPS resin are kneaded together with an additive in a kneader to make a compound in pellet form. This compound is poured into an injection molding machine, and after it is heated and melted in a cylinder, injected into a metallic mold for formation. The viscosity of the resin needs to be adjusted. When anisotropic magnet powders are used, a necessary magnetic circuit can be installed to the metallic mold to orient the magnet powders. In order to manufacture a high-performance anisotropic injection-molded magnet, the magnet powders need to be sufficiently oriented when the melted compound is injected into the metallic mold.

(Sixth Embodiment of the Invention)

In the present embodiment, applications of the magnet using the ferromagnetic fluorine compound will be described. The ferromagnetic fluorine compound according to the present invention can be used in a rotary electric machine. For example, PC peripherals such as a spindle motor (for HDD, CD-ROM/DVD, or FDD) and a stepping motor (a magnetic pickup for CD-ROM/DVD and a head drive for FDD) are included. As office automation equipment, a fax, a copier, a scanner, and a printer are included. For an automobile, a fuel pump, an air bag sensor, an ABS sensor, a meter, a position control motor, and an ignition device are examples. A PC game machine with a built-in HDD or DVD and a TV set box for downloading digital data from the internet or a cable TV also are included. As home electronics, a cellular phone, a digital camera, a video camera, an MP3 player, a PDA, and a stereo audio player are included. In addition to these are an air conditioner, a vacuum cleaner, and an electric power tool.

Furthermore, since the ferromagnetic fluorine compound according to the present invention has a large magnetic volume effect, it is expected to produce a Villari effect in which, when a magnetic body is pressurized, the strength of the magnetization is changed. It is a magnetostriction phenomenon in a broad sense, so the compound can be industrially utilized in a sensor or an actuator.

(Seventh Embodiment of the Invention)

In the present embodiment, a chlorination method will be discussed. A characteristic of the present invention is that the intrusion of element F increases the volume of a crystal lattice, creating a geometric effect which causes the magnetic properties to be changed. Therefore, the same effect can be expected from the element Cl (chlorine) instead of the element F. The reaction method and the reaction device are the same as those described in the first embodiment. Note that there is a chlorination method that uses the thermal decomposition of ammonium chloride ($NH_4Cl$, decomposes at 338° C.) as a chlorinating-gas generation source, and a chlorination method that uses a gas flow of nitrogen trichloride ($NCl_3$), boron trichloride ($BCl_3$), hydrogen chloride (HCl), or chlorine ($Cl_2$). Naturally, mixing or simultaneous use of these are allowed, and it is also possible to combine these methods with any fluorination method described in the first embodiment, carbonization, hydrogenation, or nitrogenization. The chlorination process using ammonium chloride is preferably performed at 350° C. or above. The ferromagnetic chloride manufactured as above is suitable for using in a bond magnet by the methods described in the fourth and the fifth embodiments.

(Eighth Embodiment of the Invention)

The present embodiment will discuss about a study done on the fluorination of magnetic powders around which, a thin fluoride film is formed to reduce the oxidation and decomposition of a parent phase during fluorination.

A film-forming liquid for forming a coating film of rare-earth fluoride or alkaline-earth metal fluoride was prepared as follows. For example, $PrF_3$ (praseodymium trifluoride) was used in the present embodiment. After dissolving 4 g of praseodymium acetate or praseodymium nitrate into 100 ml of water, hydrofluoric acid diluted to 1% in the amount equivalent to 90% of the amount necessary for producing $PrF_3$ was gradually added while being stirred to produce $PrF_3$ gel. After supernatant liquid has been removed by centrifugation, methanol in the same amount as the remaining gel was added, then a stirring and centrifuging operation was repeated 3 to 10 times to remove negative ions, producing a nearly transparent colloidal methanol solution of $PrF_3$ (concentration: $PrF_3$/methanol=1 g/5 ml).

A process for forming a rare-earth fluoride or alkaline-earth metal fluoride coating film on magnetic powders was as follows. The magnetic powders were prepared in the same manner as in the first embodiment. Magnetic powders of an $Sm_2Fe_{17}$ or $Nd_2Fe_{17}$ phase were used in the present embodiment. They were pulverized in an inert atmosphere using a jet mill until the average grain diameter of the magnetic powders became 10 μm or smaller. 10 ml of $PrF_3$-coating film forming liquid was added per 100 g of magnetic powders having an average grain diameter of 10 μm or smaller, and mixed until wetting of the whole magnetic powders was confirmed. The solvent methanol was removed from the magnetic powders, to which the $PrF_3$-coating film forming process had been performed, under a reduced pressure of 2 to 5 torr. The solvent-removed magnetic powders were placed on a quartz boat, and heat-treated at 200° C. for 30 min and at 350° C. for 30 min under a reduced pressure of $1\times10^{-3}$ Pa. Consequently, it can be said that 2 wt % of $PrF_3$ was processed with respect to the weight of the magnetic powders.

The magnetic powders around which the $PrF_3$ film had been formed in the above method were fluorinated in the same manner as in the first embodiment, except that ammonium bifluoride was used as a fluorinating-gas generation source, and that the ammonium bifluoride and the magnetic powders were mixed to be placed on a GC boat. A small amount of ammonium fluoride was disposed only to the upstream location of the fluorinating-gas generation source locations in FIG. 1 for checking sublimation.

Figure 15:
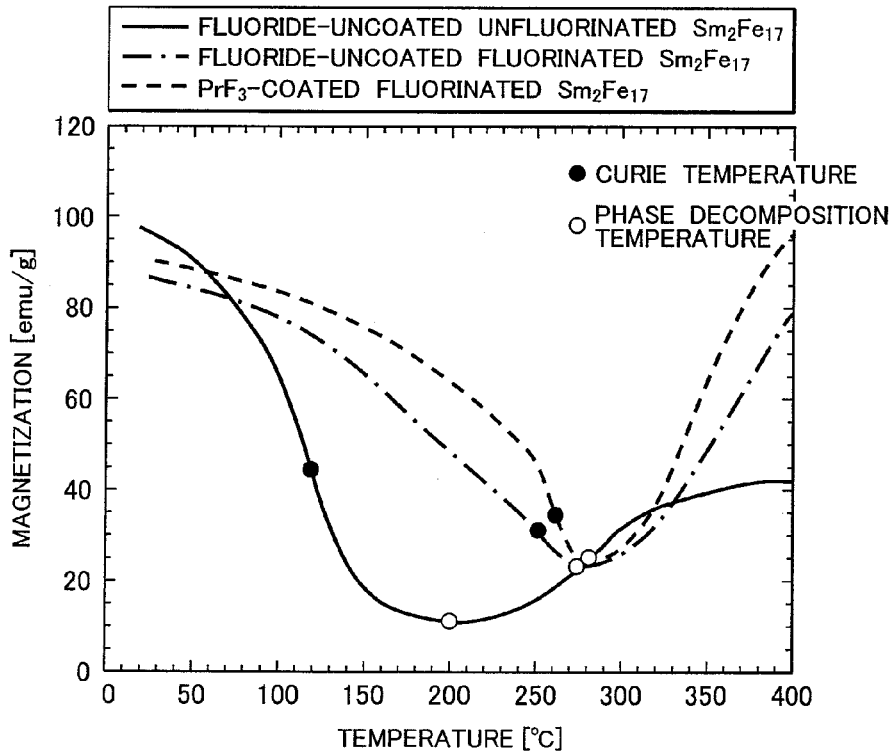
FIG. 15 is a graph showing a relationship between ambience temperature and magnetization in a magnetic field of 0.5 tesla (T) of: fluoride-uncoated and unfluorinated $Sm_2Fe_{17}$; fluoride-uncoated but fluorinated $Sm_2Fe_{17}$; and $PrF_3$-coated and fluorinated $Sm_2Fe_{17}$.

FIG. 15 is a graph showing a relationship between ambience temperature and magnetization in a magnetic field of 0.5 tesla (T) of: fluoride-uncoated and unfluorinated $Sm_2Fe_{17}$; fluoride-uncoated but fluorinated $Sm_2Fe_{17}$; and $PrF_3$-coated and fluorinated $Sm_2Fe_{17}$. Note that the fluorinating heat treatment was performed at 200° C. for 7 hours. Measurement conditions were the same as those for the temperature dependency measurement of magnetization in FIG. 4 described in the second embodiment. Magnetization did not become zero at temperatures higher than the Curie temperature because α-Fe (its Curie temperature is approximately 770° C.) was contained. The rapid increase in the magnetization corresponds to phase decomposition. The figure shows that the phase decomposition temperature is 20 to 120° C. higher than the Curie temperature. The phase decomposition occurs due to the influence of oxygen in a measurement atmosphere, thus it may be explained as oxidation. The $PrF_3$-coated and fluorinated $Sm_2Fe_{17}$ has a smoother temperature dependency of magnetization compared with the fluoride-uncoated but fluorinated $Sm_2Fe_{17}$. Presumably, this is because the $PrF_3$-coating allowed fluorination to be progressed in a relatively uniform manner. When the temperature dependency of magnetization is unsmooth and significantly off from the Brillouin function, it means that a plurality of phases were affecting the temperature dependency of magnetization, and it is believed that the reaction has not occurred evenly.

(Ninth Embodiment of the Invention)

The present embodiment will discuss about a study done on the fluorination process of $Fe_{1-x}CO_x$ ($0<x<1$) alloy powders (Co: cobalt). The alloy is characterized by forming a body-centered cubic lattice when $x\leq0.67$, and a face-centered cubic lattice when $x>0.67$ at room temperature. A composition forming an ordered lattice has been known.

The Fe and Co metals were weighed in stoichiometric proportion and resolved for uniformization. An ingot of the obtained $Fe_{1-x}CO_x$ is heat-treated for phase formation. Then, it was pulverized in an inert gas using a jet mill to make the average grain diameter 10 μm or below. A ball mill and the like may be concurrently used. In the present embodiment, the $Fe_{1-x}Co_x$ ($x=0.25$, 0.5, or 0.75) magnetic powders produced in this way were used for the fluorinating heat treatment.

Besides the above method, powders from a thin ribbon obtained by a liquid super-rapid quenching method may be used, in which method, a main-phase alloy is melted and cast on the surface of a turning roll(s) such as a single roll or twin rolls to be jet-quenched by an inert gas or a reducing gas atmosphere. The magnetic powders produced in this method are characterized by having a crystallite texture of several tens to several hundreds of nm. In addition to the alloy-pulverized powders and the thin ribbon powders, a nanoparticle process or a thin film process may also be used to manufacture the main-phase alloy. For example, gas-phase methods include a thermal CVD method, a plasma CVD method, a molecular beam epitaxy method, a sputter method, an EB evaporation method, a reactive evaporation method, a laser ablation method, and a resistance heating evaporation method. Liquid-phase methods include a coprecipitation method, a microwave heating method, a micelle method, a reverse-micelle method, a hydrothermal synthesis method, and a sol-gel method. The present invention is not to be limited by these manufacturing methods of the main-phase alloy.

In the present embodiment, the thermal decomposition and sublimation of ammonium fluoride ($NH_4F$, with a solubility in water of 45.3 mg/100 ml at 25° C.) was used in the fluorination process. Besides the thermal decomposition and sublimation of ammonium fluoride, the thermal decomposition of ammonium bifluoride ($NH_4F.HF$), ammonium silicofluoride [$(NH_4F)_2SiF_6$], and ammonium fluoroborate ($NH_4BF_4$) and the like may be utilized. When ammonium bifluoride was used in a separate fluorination experiment, it yielded a better result in the degree of fluorination than ammonium fluoride. Presumably, it is because the ammonium bifluoride contained a large amount of F and was easier to be decomposed thermally.

In the present embodiment, the same device as in FIG. 6 in the first embodiment was used for the fluorination process. A trap structure was provided in the same manner to absorb extra ammonium fluoride, ammonia ($NH_3$), and hydrogen fluoride (HF) generated by the thermal decomposition. A specimen was thinly spread on a glassy carbon (GC) boat and disposed as shown in FIG. 6. In addition to carbon, platinum or nickel may be used as a material for the sample container. A GC boat holding the ammonium fluoride powders was disposed to each of the upstream and the downstream sides of the specimen. The preparation amount of the ammonium fluoride depends on the size of the reaction space, the flow rate of gas to be passed, the temperature of heat treatment, and the duration of the heat treatment. In this experiment, a quartz tube with a radius of 28 mm and a length of 1200 mm was used to dispose 15 g of ammonium fluoride upstream and 5 g of ammonium fluoride downstream in relation to 3 g of magnetic powders.

After the tube had been evacuated with a rotary pump, 200 ml/min of Ar gas was passed and the electric furnace was heated. The heat treatment was performed at 150, 200, 300, and 400° C. for 1 hour of reaction time. The specimen may have unreacted products attached to it so that it was stored in a polyethylene container in a vacuum-packaged state.

It is preferable to mix ammonium fluoride and magnetic powders before disposing them on the GC boat to accelerate fluorination. When the mixture is used, the tube may be evacuated at the end of the heat treatment to remove any unreacted products. Since the present method involves solid-gas and low temperature reactions, it may result in an ununiform reaction. Thus, a fluidized bed or the like is preferably introduced to promote an even reaction. When the fluorinating heat temperature is 220° C. or lower, a polytetrafluoroethylene container can be used so that the fluorinating-gas generation sources and the specimen placed in the polytetrafluoroethylene container can be agitated during the reaction by a hot stirrer utilizing the magnetic properties of the specimen. On the other hand, a gas flow of nitrogen trifluoride, boron trifluoride, or hydrogen fluoride may also be used.

As a result, while all compositions showed some improvements in magnetic properties, a significant improvement was confirmed particularly in the $Fe_{0.25}Co_{0.75}$ composition forming a face-centered cubic lattice.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A ferromagnetic compound magnet, including a ferromagnetic compound based on a binary alloy containing R—Fe system, wherein R is a 4f transition element or Y, or a ternary alloy containing R—Fe-T system, wherein R is a 4f transition element or Y, and T is a 3d transition element except for Fe, or T is Mo, Nb or W, the ferromagnetic compound being characterized by:

atomic percentage of the element R to the element Fe or atomic percentage of the element R to the elements Fe and T is 15 % or lower;

an element F is incorporated into an interstitial position in a crystal lattice of the alloy by a fluorination process characterized by a reduction diffusion reaction in which the element F intrudes into a parent phase of the alloy by displacement when oxidation products naturally formed on a surface of powders of the parent-phase are reduced such that Curie temperature of the ferromagnetic compound rises with increasing a unit-cell volume of the ferromagnetic compound by an amount greater than 40° C;

the ferromagnetic compound is expressed in a chemical formula of $RFe_{12}F_z$ or $R(Fe,T)_{12}F_z$ wherein $0<z\leq1$, has a rhombohedral lattice system and has the unit-cell volume from 0.794 to 0.801 $nm^3$; and an F constituent has a concentration gradient from crystal grain boundary region of the ferromagnetic compound toward crystal grain center region thereof.

2. The ferromagnetic compound magnet according to claim 1, wherein:

the fluorination process utilizes a thermal decomposition and sublimation of an ammonium fluoride, bifluoride ammonium, ammonium silicofluoride, and ammonium fluoroborate at a temperature of 350° C. or below.

* * * * *